US009260983B2

(12) United States Patent
Nakamura

(10) Patent No.: US 9,260,983 B2
(45) Date of Patent: Feb. 16, 2016

(54) VALVE CONTROL APPARATUS FOR INTERNAL COMBUSTION ENGINE

(71) Applicant: HITACHI AUTOMOTIVE SYSTEMS, LTD., Hitachinaka-shi, Ibaraki (JP)

(72) Inventor: Makoto Nakamura, Zushi (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 0 days.

(21) Appl. No.: 14/021,382

(22) Filed: Sep. 9, 2013

(65) Prior Publication Data

US 2014/0069364 A1 Mar. 13, 2014

(30) Foreign Application Priority Data

Sep. 13, 2012 (JP) ..... 2012-201121

(51) Int. Cl.

*F01L 1/26* (2006.01)
*F01L 13/00* (2006.01)
*F01L 1/10* (2006.01)

(52) U.S. Cl.

CPC ..... *F01L 1/267* (2013.01); *F01L 13/0036* (2013.01); *F01L 13/0063* (2013.01); *F01L 1/10* (2013.01); *F01L 2820/032* (2013.01)

(58) Field of Classification Search

CPC ..... F01L 13/0026; F01L 1/267
USPC ..... 123/90.15, 90.16, 90.22
See application file for complete search history.

(56) References Cited

U.S. PATENT DOCUMENTS

| | | | | |
|---|---|---|---|---|
| 4,759,321 | A * | 7/1988 | Matsumoto et al. | 123/90.15 |
| 8,210,141 | B2 | 7/2012 | Nakamura | |
| 2007/0277755 | A1 | 12/2007 | Nakamura et al. | |
| 2009/0078223 | A1 | 3/2009 | Nakamura | |
| 2009/0188454 | A1 * | 7/2009 | Nakamura et al. | 123/90.16 |
| 2011/0120398 | A1 * | 5/2011 | Nakamura et al. | 123/90.15 |

FOREIGN PATENT DOCUMENTS

| | | | |
|---|---|---|---|
| JP | 08-210113 | A | 8/1996 |
| JP | 2007-321653 | A | 12/2007 |
| JP | 2009-074414 | A | 4/2009 |
| JP | 2009-103040 | A | 5/2009 |
| JP | 2012-002095 | A | 1/2012 |

* cited by examiner

*Primary Examiner* — Jesse Bogue
*Assistant Examiner* — Daniel Bernstein
(74) *Attorney, Agent, or Firm* — Foley & Lardner LLP

(57) ABSTRACT

A valve control apparatus includes first and second engine valves; a first drive cam configured to rotate integrally with the drive shaft; a second drive cam provided on the drive shaft and configured to rotate integrally with the drive shaft; a swing cam configured to swing; a transmission mechanism configured to convert a rotation of the first drive cam into a swinging force and to transmit the swinging force to the swing cam; a first swing arm configured to open the first engine valve by a swing of the swing cam; a second swing arm configured to open the second engine valve by a rotation of the second drive cam; a control mechanism configured to vary a swing amount of the swing cam by varying an attitude of the transmission mechanism; and a connection changeover mechanism configured to connect and disconnect the first swing arm with/from the second swing arm.

10 Claims, 22 Drawing Sheets

P
θ1
27
24a
28a
29
α
15a
15b
R
28
28b
Q
15d
15e
15
15c
21
S
17a
19
17
7
7b
7d
4
Y
34
30
30b
33a
3a
10a
34a
37b
32
42
30a
17b
T
18
7c
13
13a
13b
35
35a
31
31b
33b
3b
10b
37a
31a
5a
16
16a
16c
X

P
27
24a
28a
29
α
15a
15b
R
28
28b
Q
15d
15
15c
15e
21
S
17a
19
17
18
7c
T
17b
7
Y
4
7b
30
34
34a
37b
32
42
30a
7d
30b
33a
3a
10a
γ1
β1
α1
16
5a
16a
16c
X
13
13a
13b
35
35a
31
31a
31b
33b
3b
10b
37a

P
27
24a
28a
α
29
15a
15b
R
13
13a
4
35
31
31b
33b
3b
10b
θ2
28
28b
Q2
15d
15e
15c
15
21
S
17a
19
17
16
5a
16a
16c
X
Y
7
7b
7d
34
30
30b
33a
3a
10a
34a
37b
32
37a
31a
35a
13b
42
30a
17b
T
18
7c

P
27
24a
28a
28
28b
α
15d
Q2
29
15a
15b
15
15c
15e
21
S
17a
19
17
R
13
13a
4
13b
35
35a
31
31a
31b
32
33b
3b
10b
37a
37b
16
5a
16a
16c
β2
α2
γ2
X
Y
7
7b
7c
7d
17b
18
T
30
30a
30b
33a
3a
10a
34
34a
42

27
24a
28
28b
α
15d
29
15a
15b
R
Q3
P
28a
15
15c
21
17a
S
19
15e
17
18
7c
T
17b
7
Y
4
7b
7d
34
30
30b
33a
3a
10a
34a
37b
38
32
42
30a
16
5a
16a
16c
β3
α3
γ3
X
13
13a
13b
C
35
35a
31
31b
33b
3b
10b
37a
31a 27
24a
28
28b
α
15d
29
15a
15b
P
28a
Q3
R
15
15c
21
17a
S
19
15e
17
18
7c
T
17b
7g
7d
30
30a
42
32
38
37b
34a
34
C1
7b
7e
4
Y
7f
14
7h
7
16
5a
16a
16c
β3
α3
γ3
X
30b
33a
3a
10a
50
50a
50b
51
51a
31
31a
31b
33b
3b
10b
37a 27
24a
28
28b
α
15d
29
15a
15b
R
Q3
P
28a
15
15c
21
17a
S
19
15e
17
7c
18
T
17b
7g
7d
30
30a
42
32
38
37b
34a
34
7b
4
Y
7e
7f
14
7
7h
14
30b
33a
3a
10a
16
5a
16a
16c
β3
α3
γ3
X
50
50b
μ
51a
51
50a
31b
33b
3b
10b
37a
31
31a

VALVE CONTROL APPARATUS FOR INTERNAL COMBUSTION ENGINE

BACKGROUND OF THE INVENTION

The present invention relates to a valve control apparatus for an internal combustion engine, which is able to vary a characteristic such as a lift amount of intake valve and/or exhaust valve in accordance with an operating state of the engine.

Japanese Patent Application Publication No. 2009-103040 discloses a previously-proposed valve control apparatus in the field. This valve control apparatus includes a holder which varies its swing position by a control cam, and a sub-cam which is driven by an intake cam and which swings about a support shaft fixed to the holder. The sub-cam includes a drive cam surface and a rest cam surface. The drive cam surface drives a first intake valve through a first rocker arm. The rest cam surface drives a second intake valve through a second rocker arm. Moreover, the valve control apparatus further includes a connection changeover mechanism which connects the first rocker arm with the second rocker arm or disconnects the first rocker arm from the second rocker arm.

In a high-load region of engine, the connection changeover mechanism connects the first rocker arm with the second rocker arm so that both of the first and second intake valves are driven (opened and closed) by the drive cam surface which produces a large lift. Thereby, an intake-air charging efficiency is enhanced to increase an output torque of the engine.

On the other hand, in a low-load region of the engine, the connection changeover mechanism disconnects the first rocker arm from the second rocker arm. Thereby, the first intake valve is driven by the drive cam surface, and the second intake valve is made substantially in a closed state (minute-lift state) by the rest cam surface which produces a small lift. Because of this lift difference between the first and second intake valves, an intake-air swirl effect is produced in a cylinder, so that a combustion of the engine is improved. Hence, a fuel economy is improved.

SUMMARY OF THE INVENTION

However, in the above-mentioned previous valve control apparatus, lift characteristics of the first and second intake valves vary in conjunction with each other in a case that the swing position of the holder is varied by controlling a phase of the control cam under the unconnected state between both the rocker arms.

That is, because the drive cam surface and the rest cam surface which drive the respective first and second rocker arms are formed together in the sub-cam, both the cam surfaces operate with the same swing-operating characteristic.

As a result, as shown in FIG. 9 of the above valve control apparatus, when a working angle (corresponding to a valve-open period) of the first intake valve which produces the large lift is varied, a working angle of the second intake valve which produces the small lift is varied subordinately in conjunction with the variation of the working angle of the first intake valve. Thereby, various inconveniences are caused. For example, when the working angle of the second intake valve has become relatively small, a function to enable fuel and contamination stored at an upper surface of an umbrella portion of the second intake valve during a valve-closed period to be removed during the valve-open period is weakened. Hence, there is a risk that a time-dependent change of combustion is caused. On the other hand, when the working angle of the second intake valve has become relatively large, there is a risk that the swirl function is weakened to worsen the combustion. Moreover, there is a risk that a friction of valve system is increased to worsen a fuel economy.

It is therefore an object of the present invention to provide a valve control apparatus devised to solve or ease the above-mentioned problem.

According to one aspect of the present invention, there is provided a valve control apparatus for an internal combustion engine, comprising: a first engine valve biased in a closing direction of the first valve by a biasing force of a valve spring; a second engine valve biased in a closing direction of the second valve by a biasing force of a valve spring; a first drive cam provided on a drive shaft and configured to rotate integrally with the drive shaft, the drive shaft being configured to rotate in synchronization with a crankshaft; a second drive cam provided on the drive shaft and configured to rotate integrally with the drive shaft; a swing cam configured to swing; a transmission mechanism configured to convert a rotational motion of the first drive cam into a swinging force and to transmit the swinging force to the swing cam; a first swing arm configured to open the first engine valve by being pressed by a swing of the swing cam; a second swing arm configured to open the second engine valve by being pressed by a rotation of the second drive cam; a control mechanism configured to vary a swing amount of the swing cam by varying an attitude of the transmission mechanism; and a connection changeover mechanism configured to connect and disconnect the first swing arm with/from the second swing arm.

According to another aspect of the present invention, there is provided a valve control apparatus for an internal combustion engine, comprising: a first drive cam configured to be rotated drivingly by a rotational force of a crankshaft; a second drive cam configured to be rotated drivingly by the rotational force of the crankshaft; a first engine valve biased in a closing direction of the first valve by a valve spring; a second engine valve biased in a closing direction of the second valve by a valve spring; a transmission mechanism configured to convert a rotational motion of the first drive cam into a swinging motion and to transmit the swinging motion to a swing cam; a control mechanism configured to vary a swing amount of the swing cam by varying an attitude of the transmission mechanism; a first follower configured to open and close the first engine valve by a contact with the swing cam; a second follower configured to open and close the second engine valve by a contact with the second drive cam; and a changeover mechanism configured to form an interlock between opening amount and open-close timing of the first follower and opening amount and open-close timing of the second follower, and configured to release the interlock.

According to still another aspect of the present invention, there is provided a valve control apparatus for an internal combustion engine, comprising: a pair of engine valves including a first engine valve and a second engine valve; a first follower configured to drivingly open and close the first engine valve; a second follower configured to open and close the second engine valve; a first drive cam configured to rotate in synchronization with a crankshaft; a swing cam configured to drivingly press the first follower; a transmission mechanism configured to convert and transmit a rotational motion of the first drive cam to a swinging motion of the swing cam; a control mechanism configured to vary a transfer characteristic of the transmission mechanism by varying an attitude of the transmission mechanism; a second drive cam configured to rotate in synchronization with the crankshaft and to drive the second follower; and a changeover mechanism configured to switch between an interlocked state of the first follower and the second follower and a non-interlocked state of the first follower and the second follower.

The other objects and features of this invention will become understood from the following description with reference to the accompanying drawings.

BRIEF DESCRIPTION OF DRAWINGS

FIG. 4A is a cross sectional view of FIG. 2 which is taken along a line A-A, under a closed state of first intake valve. FIG. 4B is a cross sectional view of FIG. 2 which is taken along a line B-B, under the closed state of the first intake valve. FIG. 4C is a cross sectional view of FIG. 2 which is taken along a line C-C, under the closed state of the first intake valve (and also under a closed state of second intake valve).

FIG. 5A is a cross sectional view of FIG. 2 which is taken along the line A-A, at the time of peak lift under an open state of the first intake valve. FIG. 5B is a cross sectional view of FIG. 2 which is taken along the line B-B, at the time of peak lift under the open state of the first intake valve. FIG. 5C is a cross sectional view of FIG. 2 which is taken along the line C-C, and shows a state where the second intake valve is open at the time of peak lift under the open state of the first intake valve.

FIG. 6A is a cross sectional view of FIG. 2 which is taken along the line A-A, under the closed state of the first intake valve. FIG. 6B is a cross sectional view of FIG. 2 which is taken along the line B-B, under the closed state of the first intake valve. FIG. 6C is a cross sectional view of FIG. 2 which is taken along the line C-C, under the closed state of the first intake valve (and also under the closed state of the second intake valve).

FIG. 7A is a cross sectional view of FIG. 2 which is taken along the line A-A, at the time of peak lift under the open state of the first intake valve. FIG. 7B is a cross sectional view of FIG. 2 which is taken along the line B-B, at the time of peak lift under the open state of the first intake valve. FIG. 7C is a cross sectional view of FIG. 2 which is taken along the line C-C, and shows a state where the second intake valve is also open under the open state of the first intake valve.

FIG. 8A is a cross sectional view of FIG. 2 which is taken along the line A-A, under the closed state of the first intake valve. FIG. 8B is a cross sectional view of FIG. 2 which is taken along the line B-B, under the closed state of the first intake valve. FIG. 8C is a cross sectional view of FIG. 2 which is taken along the line C-C, under the closed state of the first intake valve (and also under the closed state of the second intake valve).

FIG. 9A is a cross sectional view of FIG. 2 which is taken along the line A-A, at the time of peak lift under the open state of the first intake valve. FIG. 9B is a cross sectional view of FIG. 2 which is taken along the line B-B, at the time of peak lift under the open state of the first intake valve. FIG. 9C is a cross sectional view of FIG. 2 which is taken along the line C-C, and shows a state where the second intake valve is open at the time of peak lift under the open state of the first intake valve.

FIG. 16A is a cross sectional view at the time of peak lift under the open state of the first intake valve. FIG. 16B shows a rotational position of first drive cam at this time. FIG. 16C is a cross sectional view showing the open state of the second intake valve at this time.

FIG. 19A is a cross sectional view showing a controlled state of the first intake valve to the maximum lift amount. FIG. 19B is a cross sectional view showing a rotational position of the first drive cam at this time. FIG. 19C is a cross sectional view showing the closed state of the second intake valve at this time.

DETAILED DESCRIPTION OF THE INVENTION

Figure 1:
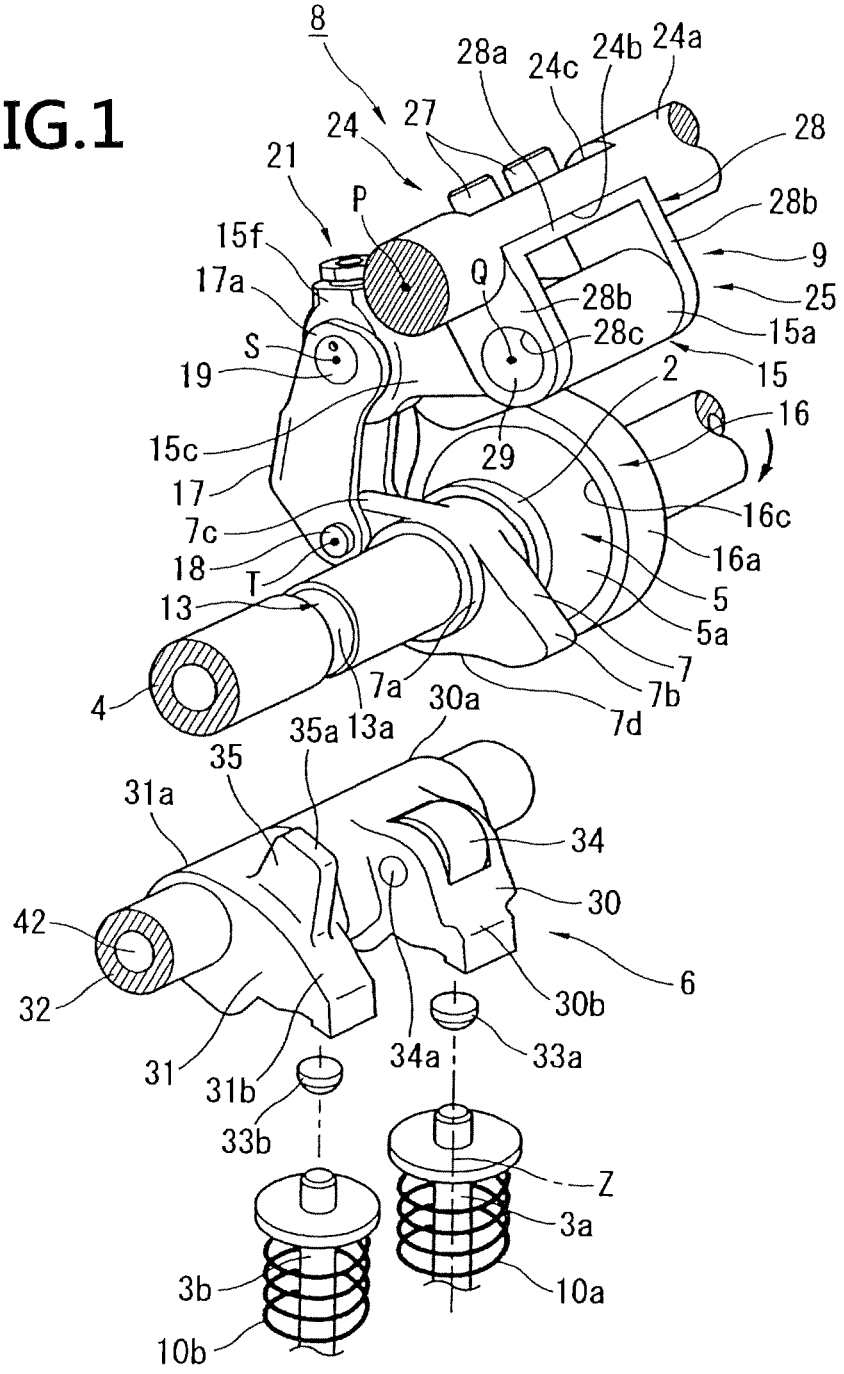
FIG. 1 is an exploded oblique-perspective view showing main parts of a valve control apparatus in a first embodiment according to the present invention.

Hereinafter, embodiments of valve control apparatus for internal combustion engine according to the present invention will be described referring to the drawings. In each embodiment, the valve control apparatus is applied to an intake side and/or an exhaust side of multi-cylinder internal combustion engine.

[First Embodiment]

Figure 2:
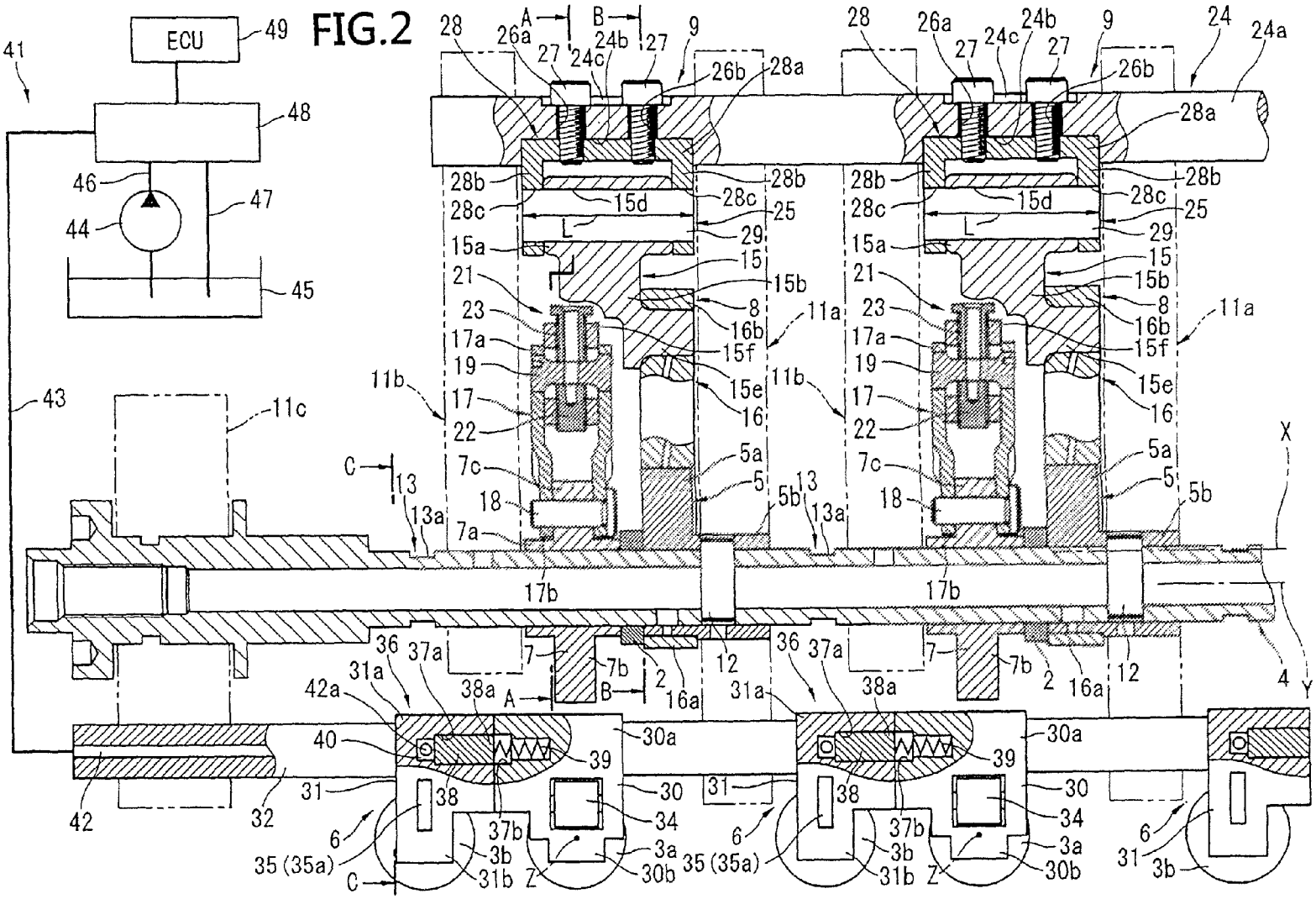
FIG. 2 is a cross sectional view of the main parts of the valve control apparatus in the first embodiment.

As shown in FIGS. 1 and 2, a valve control apparatus in a first embodiment according to the present invention includes first and second intake valves 3*a* and 3*b*, a drive shaft 4, a swing mechanism 6, a single swing cam 7, a first drive cam 5, a transmission mechanism 8, and a control mechanism 9. Each of the first and second intake valves 3*a* and 3*b* is provided slidably in a cylinder head 1 through a valve guide (not shown), and opens and closes an intake port. Each cylinder of the plurality of cylinders is equipped with the first and second intake valves 3*a* and 3*b*, i.e., two engine valves. The drive shaft 4 is disposed in a front-rear direction of the engine, and is formed in an internally hollow shape. The swing mechanism 6 is provided on upper end portions of the respective intake valves 3*a* and 3*b*. The single swing cam 7 operates opening/closing movements of, in principle, the first intake valve 3*a* through the swing mechanism 6. The after-explained first drive cam 5 is provided on an outer circumference of the drive shaft 4. The transmission mechanism 8 links or coordinates the first drive cam 5 with the swing cam 7. The transmission mechanism 8 converts a rotational force of the first drive cam 5 to a swinging motion, and transmits this swinging motion to the swing cam 7 as a swinging force. Thus, the control mechanism 9 controls the first intake valve 3*a* so as to continuously vary a valve lift-amount characteristic of the first intake valve 3*a* and a valve working angle (valve-open-period angle range) of the intake valve 3*a* in accordance with an operating state of the engine, by varying an attitude (position) of the transmission mechanism 8 and thereby varying a swing range of the swing cam 7.

In this embodiment, the valve working angle means a time interval for which each intake valve 3*a*, 3*b* is open. Moreover, the swing cam 7 cooperates with the transmission mechanism 8 and the control mechanism 9 to define a variable mechanism. This variable mechanism is provided to every cylinder. That is, each cylinder has one variable mechanism which is constituted by the swing cam 7, the transmission mechanism 8 and the control mechanism 9.

The first intake valve 3*a* is biased (urged) by a valve spring 10*a* in a direction that closes (blocks) an open end of the intake port. The valve spring 10*a* is resiliently attached between a bottom portion of an approximately-cylindrically-shaped bore formed in an upper end portion of the cylinder head 1 and a spring retainer provided to an upper end portion of valve stem. In the same manner, the second intake valve 3*b* is biased by a valve spring 10*b* in a direction that closes or blocks an open end of the intake port. The valve spring 10*b* is resiliently attached between a bottom portion of an approximately-cylindrically-shaped bore formed in the upper end portion of cylinder head 1 and a spring retainer provided to an upper end portion of valve stem.

Predetermined axial portions and both end portions of the drive shaft 4 are rotatably supported by first and second bearing portions 11*a* and 11*b* and bearing portions 11*c*. The first and second bearing portions 11*a* and 11*b* are provided in an upper portion of the cylinder head 1 and are arranged on both lateral portions of the variable mechanism. Each cylinder includes one pair of first and second bearing portions 11*a* and 11*b*. The bearing portions 11*c* are provided on the both end portions of the drive shaft 4. The drive shaft 4 is formed with an oil passage provided axially inside the drive shaft 4. Lubricating oil passed through the oil passage is supplied to the respective bearing portions 11*a* to 11*c* and the like. The first drive cam 5 is fixed to a predetermined axial portion of the outer circumference of the drive shaft 4. Moreover, a second drive cam 13 is provided at a location axially separated from (axially away from) the first drive cam 5. Every cylinder includes one first drive cam 5 and one second drive cam 13.

Moreover, a timing chain (not shown) is provided on one end portion of the drive shaft 4, and thereby, rotational force is transmitted from a crankshaft of the engine through the timing chain to the drive shaft 4. Thus, the drive shaft 4 is able to rotate in a clockwise direction (arrow direction) of FIG. 1.

The first drive cam 5 includes a cam main body 5*a* and a boss portion 5*b*. The cam main body 5*a* is formed approximately in a disc shape. As shown in FIG. 2, the boss portion 5*b* is formed in a tubular shape, and is provided integrally with an (axially) outside portion of the cam main body 5*a*. The first drive cam 5 is fixed to the drive shaft 4 by a fixing pin 12. The fixing pin 12 passes through a pin hole which was drilled in the boss portion 5*b* in a radial direction. Moreover, the first drive cam 5 is disposed on one end side (i.e., on one lateral side) of the swing cam 7 relative to an axial direction of the drive shaft 4. The boss portion 5*b* is located on an opposite side of the cam main body 5*a* from the swing cam 7. An outer circumferential surface of the cam main body 5*a* is formed in a cam profile of eccentric circle. That is, a shaft center X (i.e., a center of the outer circumferential surface) of the cam main body 5*a* is offset (deviated) from a shaft center Y of the drive shaft 4 in the radial direction by a predetermined amount.

Figures 4A, 4B, 4C:
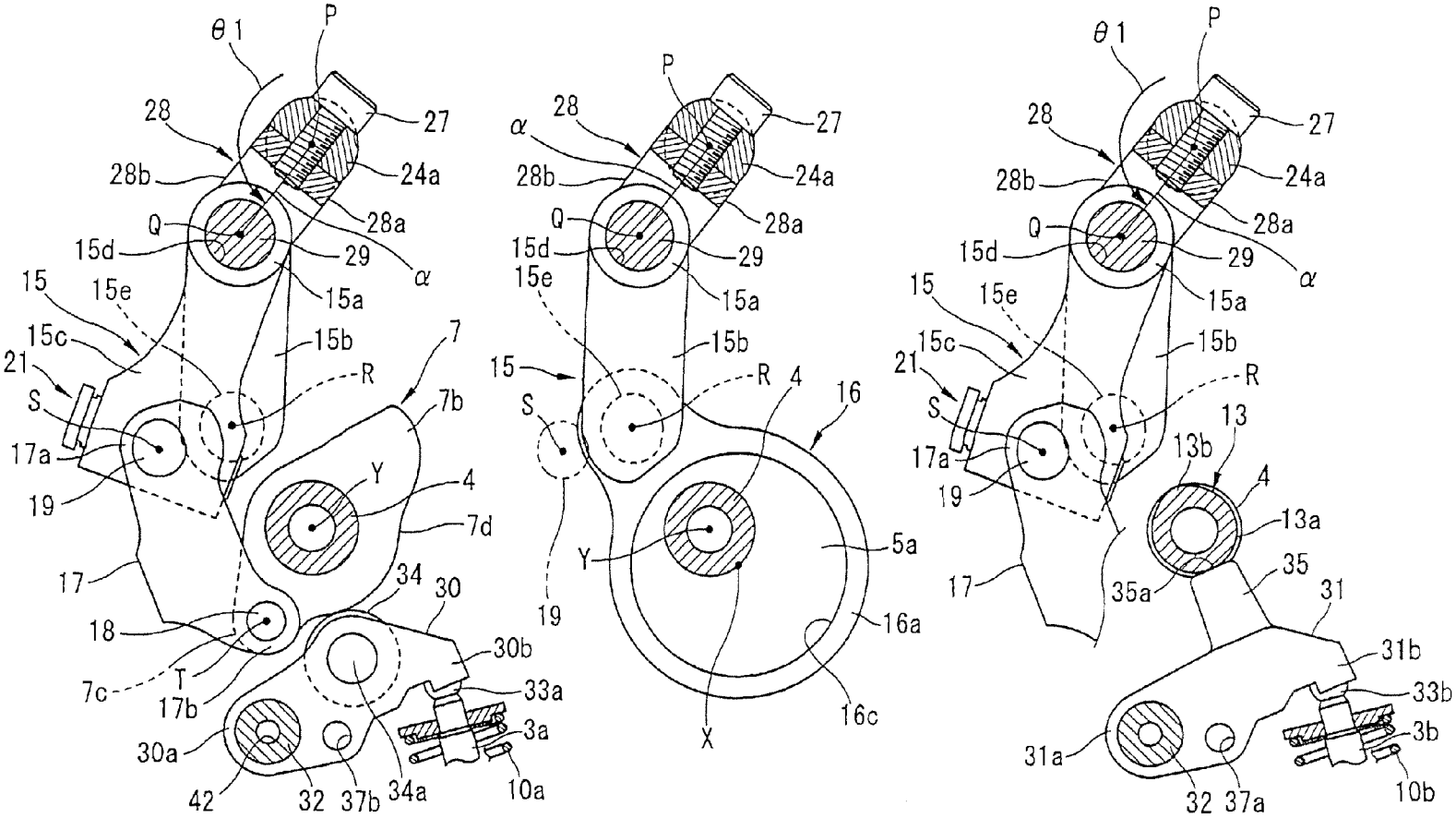
FIGS. 4A to 4C are cross sectional views under a minimum working angle.

As shown in FIGS. 1 and 4C, the second drive cam 13 is formed by cutting an outer circumferential surface of the drive shaft 4 along a circumferential direction of the drive shaft 4. An outer circumferential surface 13*a* of the second drive cam 13 is formed in a circular (annular) shape having a small diameter in cross section taken by a plane perpendicular to the axial direction such that the outer circumferential surface 13*a* is constituted as a so-called oval cam (egg-shaped cam). The entire outer diameter of the second drive cam 13 is smaller than an outer diameter of the drive shaft 4. The outer circumferential surface 13*a* of the second drive cam 13 includes a base circular portion and a cam nose portion 13*b* as shown in FIG. 4C. When the second drive cam 13 rotates in synchronization with the derive shaft 4, the base circular portion and the cam nose portion 13*b* of the outer circumferential surface 13*a* open and close the second intake valve 3*b* through an after-mentioned second swing arm 31 of the swing mechanism 6.

As shown in FIG. 1, the swing mechanism 6 is constituted by two of a first swing arm 30 functioning as a first follower and the second swing arm 31 functioning as a second follower. The second swing arm 31 is provided adjacent to a lateral portion of the first swing arm 30 relative to the axial direction. The both swing arms 30 and 31 are provided independently from each other (i.e., provided as components that can move independently from each other). The first swing arm 30 includes a base end portion 30*a* and a tip portion 30*b*, and the second swing arm 31 includes a base end portion 31*a* and a tip portion 31*b*. The base end portions 30*a* and 31*a* are swingably supported by one rocker shaft 32. The tip portions 30*b* and 31*b* protrude in the same direction respectively from the base end portions 30*a* and 31*a*. A lower surface of the tip portion 30*b* is formed with a circular concave portion. Similarly, a lower surface of the tip portion 31*b* is formed with a circular concave portion. The tip portion 30*b* is in contact with the upper surface of a stem end of first intake valve 3*a* through a disc-shaped shim 33*a* fitted into the concave portion of tip portion 30*b*. Similarly, the tip portion 31*b* is in contact with the upper surface of a stem end of second intake valve 3*b* through a disc-shaped shim 33*b* fitted into the concave portion of tip portion 31*b*.

The first swing arm 30 is provided at a location identical with a location of the swing cam 7 relative to a width direction of the engine (right-left direction of FIG. 4A). A roller 34 is provided to an approximately center portion of width range of the first swing arm 30 relative to the axial direction of rocker shaft 32. The roller 34 rotatably abuts on an after-mentioned cam surface of the swing cam 7. An approximately center portion of this roller 34 relative to a width direction of roller 34 accords with the location of an axis (stem center) Z of the valve stem of first intake valve 3*a*. The roller 34 is rotatably received by a concave groove of the first swing arm 30 through a roller shaft 34*a*. This concave groove is formed at an approximately center portion of the first swing arm 30. An upper end portion of the roller 34 is constantly exposed to the side of swing cam 7.

The second swing arm 31 is provided to be offset from (away from) the swing cam 7 in the axial direction. Hence, the swinging force of swing cam 7 is not directly transmitted to the second swing arm 31. A spherical lower surface of the shim 33*b* fitted in the tip portion 31*b* is in contact with the upper surface of stem end of second intake valve 3*b*. When an after-mentioned connection changeover mechanism 36 connects (interlocks) the second swing arm 31 with the first swing arm 30, the second swing arm 31 largely opens the second intake valve 3*b* by pressing against a spring force of the valve spring 10*b*.

The second swing arm 31 includes a slip convex portion 35 at an approximately center portion of the second swing arm 31 relative to a width direction of the second swing arm 31. That is, the slip convex portion 35 is formed integrally with the second swing arm 31 to protrude from an upper surface of the second swing arm 31. The slip convex portion 35 is formed in an approximately rectangular shape as viewed from the axial direction of the rocker shaft 32. The slip convex portion 35 has a slip surface 35*a* as an upper surface of the slip convex portion 35. When the second swing arm 31 is swinging, the slip surface 35*a* of the slip convex portion 35 is elastically in contact with the outer circumferential surface 13*a* of the second drive cam 13 in the radial direction of the second drive cam 13 by the biasing force of the valve spring 10*b*.

The respective lower surfaces of shims 33*a* and 33*b* which are in contact with the first and second intake valves 3*a* and 3*b* are formed in an approximately spherical shape. Thereby, when each swing arm 30, 31 swings, the shim 33*a*, 33*b* can press a portion near the center (line Z of FIGS. 1 and 2) of stem end of the intake valve 3*a*, 3*b*.

Moreover, a thickness of the shim 33*a* is appropriately selected by selecting from multiple shims having different thickness values, so that a space between the stem end of first intake valve 3*a* and the shim 33*a* is adjusted to become a slight clearance near zero especially when the first intake valve 3*a* is in a non-lifted state (closed state). Similarly, the shim 33*b* is appropriately selected among multiple shims having different thickness values, so that the a space between the stem end of second intake valve 3*b* and the shim 33*b* is adjusted to become a slight clearance near zero when the second intake valve 3*b* is in the non-lifted state (the closed state) under a state where the both swing arms 30 and 31 have been connected (interlocked) with each other by the after-mentioned connection changeover mechanism 36.

As shown in FIG. 2, the connection changeover mechanism 36 includes a first retaining hole 37*a*, a second retaining hole 37*b*, a connecting pin 38, a coil spring 39, a pressure-receiving chamber 40, and a hydraulic circuit 41. The second swing arm 31 is formed with the first retaining hole 37*a* which functions as a connection hole of the second swing arm 31. The first swing arm 30 is formed with the second retaining hole 37*b* which functions as a connection hole of the first swing arm 30. The first retaining hole 37*a* and the second retaining hole 37*b* are formed continuously inside the both base end portions 30*a* and 31*a* of swing arms 30 and 31 in the axial direction. The connecting pin (connecting member) 38 is provided for the interlock between the first and second swing arms 30 and 31, and is retained in the first retaining hole 37*a*. A front-end portion 38*a* of the connecting pin 38 can slide into the second retaining hole 37*b* so as to engage the first swing arm 30 with the second swing arm 31. The coil spring 39 is elastically retained in the second retaining hole 37*b*, i.e., is a biasing member for biasing the connecting pin 38 toward the first retaining hole 37*a*. The pressure-receiving chamber 40 is formed on a rear-end side of the first retaining hole 37*a*. The pressure-receiving chamber 40 can apply oil pressure to the connecting pin 38 to appropriately move the connecting pin 38 toward the second retaining hole 37*b* against the biasing force of coil spring 39. The hydraulic circuit 41 supplies/discharges oil pressure to/from the pressure-receiving chamber 40.

The hydraulic circuit 41 includes a hydraulic-pressure supply/discharge passage 43, an oil pump 44, an electromagnetic changeover valve 48, and an electronic controller (ECU) 49. As shown in FIG. 2, the hydraulic-pressure supply/discharge passage 43 supplies and discharges working oil pressure to/from the pressure-receiving chamber 40 through an oil hole 42*a* and an oil passage 42. The oil passage 42 is formed axially inside the rocker shaft 32. The oil pump 44 pumps working oil stored in an oil pan 45, through a supply passage 46 to the hydraulic-pressure supply/discharge passage 43. The electromagnetic changeover valve 48 switches between the supply passage 46 and a drain passage 47 in order to communicate one of the supply passage 46 and the drain passage 47 with the hydraulic-pressure supply/discharge passage 43. The electronic controller 49 controls the switching operation of electromagnetic changeover valve 48.

The electronic controller 49 receives information signals derived from various kinds of sensors such as a crank angle sensor, an air flow meter and an engine water-temperature sensor (not shown). Thus, the electronic controller 49 detects a current operating state of the engine, and thereby, outputs control signals to the electromagnetic changeover valve 48.

As shown in FIGS. 1 and 2, the swing cam 7 is formed approximately in a raindrop shape. The swing cam 7 is formed integrally with a cam shaft 7*a* provided on a side of base end portion of swing cam 7. The cam shaft 7*a* is formed in a short circular-tube shape, and is fitted over the outer circumferential surface of drive shaft 4 by insertion. The swing cam 7 is supported to be able to swing about the shaft center Y of drive shaft 4 via the cam shaft 7*a*. That is, the shaft center Y serves as a swing axis of the swing cam 7. (FIG. 4A)

The swing cam 7 includes a cam nose portion 7*b* in a tip side of the swing cam 7. As shown in FIG. 4A, a lower surface of the swing cam 7 includes a cam surface 7*d* formed between the base end portion of the swing cam 7 and the cam nose portion 7*b*. This cam surface 7*d* includes a base circular surface, a ramp surface and a lift surface. The base circular surface is located at a side of the base end portion. The ramp surface extends in a circular-arc shape (in cross section) from the base circular surface toward the cam nose portion 7*b*. The lift surface extends from the ramp surface to a maximum-lift top surface of the cam surface 7*d*. This maximum-lift top surface is located in a tip side of the cam nose portion 7*b*. The cam surface 7*d* is in contact with the outer circumferential surface of the roller 34 of the first swing arm 30. The swing cam 7 varies the lift amount of the intake valve 3*a*, 3*b*, by varying a contact point between the cam surface 7*d* and the roller 34 in accordance with a swing position of the swing cam 7.

A swinging direction of swing cam 7 when opening the first intake valve 3*a* (i.e., when the contact point between the cam surface 7*d* and the roller 34 moves toward the lift surface) is identical with a rotational direction of the drive shaft 4 (arrow direction in FIG. 1). Accordingly, a drag torque is applied to the swing cam 7 in the direction that lifts the first intake valve 3*a*, because of a friction coefficient between the drive shaft 4 and the swing cam 7. Therefore, a drive efficiency of the swing cam 7 is improved.

Moreover, the swing cam 7 includes a connecting portion 7*c* located on an opposite side of the cam shaft 7*a* from the cam nose portion 7*b*. That is, the cam shaft 7*a* is located between the cam nose portion 7*b* and the connecting portion 7*c*, and this connecting portion 7*c* is formed integrally with the swing cam 7 to protrude from the swing cam 7. The connecting portion 7*c* is formed with a pin hole passing through both lateral surfaces of the connecting portion 7*c*, i.e., passing through the swing cam 7 in the axial direction of drive shaft 4. A connecting pin 18 for connecting the swing cam 7 with an after-mentioned another end portion 17*b* of link rod 17 is inserted into the pin hole.

As shown in FIGS. 1 to 4C, the transmission mechanism 8 includes a rocker arm 15, a link arm 16 and the link rod 17. The rocker arm 15 is disposed (to extend) along the width direction of engine above the drive shaft 4. The link arm 16 links the rocker arm 15 with the drive cam 5. The link rod 17 links the rocker arm 15 with the connecting portion 7*c* of swing cam 7. That is, the transmission mechanism 8 is constructed as a mechanical multi-joint link mechanism including the rocker arm 15, the link arm 16 and the link rod 17.

Figure 3A:
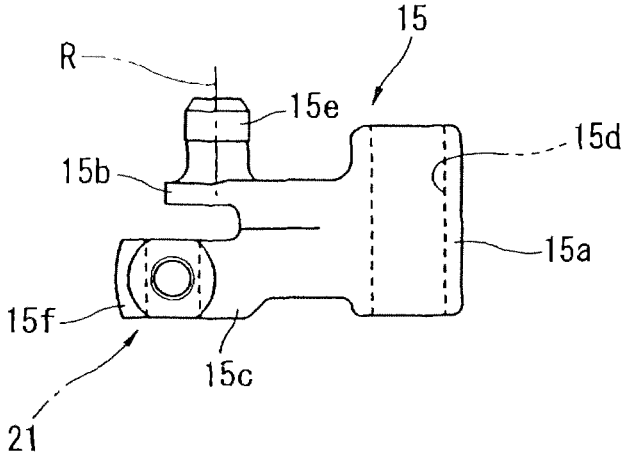
FIG. 3A is a plan view of a rocker arm provided in the first embodiment.
Figure 3B:
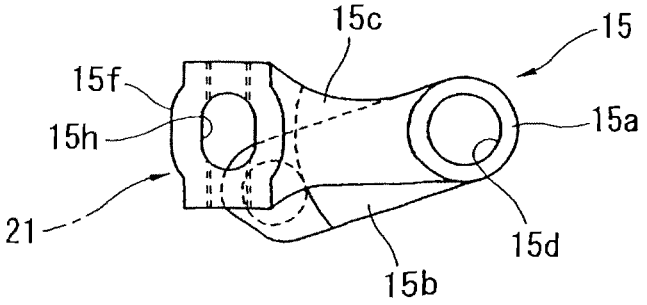
FIG. 3B is a side view of the rocker arm.

As shown in FIGS. 3A and 3B, the rocker arm 15 includes a tubular base portion 15*a*, a first arm portion 15*b* and a second arm portion 15*c*. The tubular base portion 15*a* is located in one end side of the rocker arm 15, and is swingably supported by an after-mentioned control eccentric shaft 29. The first and second arm portions 15*b* and 15*c* are located in another end side of the rocker arm 15, and are provided to protrude approximately parallel to each other from an outer surface of the tubular base portion 15*a* toward an inside of the engine, in a biforked manner.

The tubular base portion 15*a* is formed with a support hole 15*d* passing through the tubular base portion 15*a*. The tubular base portion 15*a* is supported by causing the support hole 15*d* to be fitted over an after-mentioned outer circumference of the control eccentric shaft 29 through a minute clearance therebetween.

The first arm portion 15*b* is formed integrally with a shaft portion 15*e* that protrudes from an outside surface of tip portion of the first arm portion 15*b*. The shaft portion 15*e* is linked rotatably with an after-mentioned protruding end 16*b* of the link arm 16.

On the other hand, the second arm portion 15*c* includes a block portion 15*f* at a tip portion of second arm portion 15*c*. A lift adjusting mechanism 21 is provided to the block portion 15*f*. One end portion 17*a* of the link rod 17 is linked rotatably with an after-mentioned pivotally-supporting pin 19 of the lift adjusting mechanism 21.

Moreover, the block portion 15*f* is formed with an elongate hole (slot hole) 15*h* passing through the block portion 15*f* in a lateral direction of the block portion 15*f*. That is, the elongate hole 15*h* is formed to pass from one side of block portion 15*f* to another side of block portion 15*f* in the axial direction of drive shaft 4. The pivotally-supporting pin 19 laterally inserted in the elongate hole 15*h* is capable of moving within the elongate hole 15*h* in an upper-lower direction, i.e., moving along the elongate shape of hole 15*h*, for adjustment.

The first arm portion 15*b* and the second arm portion 15*c* are provided to have angles different from each other in a swinging direction of the rocker arm 15. That is, there is some angle between an imaginary linkage center line of the first arm portion 15*b* and an imaginary linkage center line of the second arm portion 15*c*. Also, the first arm portion 15*b* and the second arm portion 15*c* are positioned to deviate from each other in the upper-lower direction. The tip portion of first arm portion 15*b* is more inclined toward the lower direction by a slight inclination angle than the tip portion of the second arm portion 15*c*.

As shown in FIGS. 1, 2 and 4B, the link arm 16 includes an annular portion (circular tube portion) 16*a* and the protruding end 16*b*. The annular portion 16*a* has a relatively large diameter. The protruding end 16*b* is provided to protrude from a predetermined portion of outer circumferential surface of the annular portion 16*a*. A fitting hole 16*c* is formed at a center portion of the annular portion 16*a*. The fitting hole 16*c* is rotatably fitted over an outer circumferential surface of the cam main body 5*a* of the drive cam 5 so that the drive cam 5 rotatably supports the link arm 16.

The link rod 17 includes both rod portions located away from each other in the axial direction of drive shaft 4. These two rod portions are integrally formed by press molding. Hence, the link rod 17 is shaped like a U-shape in cross section. In order to attain a compactification inside the link rod 17, the link rod 17 is formed by being bent in an approximately circular-arc shape. The one end portion 17*a* (of each rod portion) of link rod 17 is connected with the second arm portion 15*c* through the pivotally-supporting pin 19 inserted into a pin hole of the one end portion 17*a*. The another end portion 17*b* of link rod 17 is connected rotatably with the connecting portion 7*c* of the swing cam 7 through the connecting pin 18 inserted into a pin hole of the another end portion 17*b*. Moreover, since only one link rod 17 is provided to each cylinder of the engine, a structure of the valve control apparatus can be simplified while lightening a weight of the apparatus.

The swing cam 7 swings in the lifting direction when the link rod 17 raises (pulls up) the connecting portion 7*c*. Since the cam nose portion 7*b* that receives an input from the roller 34 is located on the opposite side of a swinging center of swing cam 7 from the connecting portion 7*c*, a generation of fall (inclination) of swing cam 7 can be suppressed.

As shown in FIGS. 1 and 2, the lift adjusting mechanism 21 includes the pivotally-supporting pin 19, an adjusting bolt 22, and a lock bolt 23. The pivotally-supporting pin 19 is provided in the elongate hole 15*h* of block portion 15*f* of second arm portion 15*c* of rocker arm 15. The adjusting bolt 22 is screwed into an adjusting female threaded hole from its lower side. This adjusting female threaded hole is drilled in a lower portion of the block portion 15*f* toward the elongate hole. Moreover, a fixing female threaded hole is drilled in an upper portion of the block portion 15*f* toward the elongate hole. The lock bolt 23 is screwed into the fixing female threaded hole from its upper side.

After an assembling of the respective structural elements, a fine adjustment for the lift amount of each intake valve 3*a*, 3*b* is carried out by adjusting an up-down position of the pivotally-supporting pin 19 within the elongate hole 15*h* (a position set along elongate shape of the elongate hole 15*h*) by use of the adjusting bolt 22. After this fine adjustment, the position of pivotally-supporting pin 19 is fixed (fastened) by tightening the lock bolt 23.

The control mechanism 9 includes a control shaft 24 and an electric actuator (not shown). The control shaft 24 is disposed parallel to the drive shaft 4, in a region above the drive shaft 4. The electric actuator is an actuator for driving a rotation of the control shaft 24.

As shown in FIGS. 1, 2 and 4A-4C, the control shaft 24 includes a control pivot shaft 24*a* and a plurality of control eccentric cams 25. The plurality of control eccentric cams 25 are provided to every cylinder, and are arranged on an outer circumference of the control pivot shaft 24*a*. The plurality of control eccentric cams 25 function as a swing fulcrum of the rocker arm 15.

The control pivot shaft 24*a* includes concave portions 24*b* and 24*c* formed at a location corresponding to the rocker arm 15. Each concave portion 24*b*, 24*c* is formed to have two surfaces opposed to each other in the axial direction of drive shaft 4 through an axial width. Two bolt-insertion holes 26*a* and 26*b* are formed to pass through the control pivot shaft 24*a* in a radial direction of control pivot shaft 24*a*, in an existing range of the concave portions 24*b* and 24*c*. That is, each of the bolt-insertion holes 26*a* and 26*b* is formed between the both concave portions 24*b* and 24*c*. These bolt-insertion holes 26*a* and 26*b* are provided to have a predetermined distance from each other in the axial direction. Each of the concave portions 24*b* and 24*c* is formed to extend in the axial direction of control pivot shaft 24*a*, and a bottom surface of each concave portion 24*b*, 24*c* is formed flat.

The plurality of control eccentric cams 25 are constituted by a bracket 28 and the control eccentric shaft 29. The bracket 28 is fixed to the concave portion 24*b* of control shaft 24 by two bolts 27 and 27. The two bolts 27 and 27 are inserted into the two bolt-insertion holes 26*a* and 26*b* from the side of concave portion 24*c*. The control eccentric shaft 29 is fixed to an tip side of the bracket 28.

The bracket 28 is formed by being bent (by means of bending forming) in an angular-U shape as viewed in a direction perpendicular to the axial direction of control pivot shaft 24*a* and parallel to the bottom surface of each concave portion 24*b*, 24*c*. The bracket 28 includes a rectangular-shaped base portion 28*a* and arm-shaped fixing portions 28*b* and 28*b*. The bracket 28 (the base portion 28*a*) is formed to extend in a longitudinal direction of the concave portion 24*b*. The base portion 28*a* is fitted into the concave portion 24*b*, and thereby, is held by the concave portion 24*b*. The arm-shaped fixing portions 28*b* and 28*b* are provided to both end portions of the bracket 28 relative to a longitudinal direction of bracket 28. That is, the arm-shaped fixing portions 28*b* and 28*b* protrude from the both end portions of bracket 28 in a lower direction of FIG. 2.

The base portion 28*a* is formed with female threaded holes in both end-portion sides of base portion 28*a* relative to the longitudinal direction. Tip potions of the bolts 27 and 27 are screwed respectively into the female threaded holes of base portion 28*a*. Each of the both fixing portions 28*b* and 28*b* is formed with a fixing hole 28*c* in a tip portion of the fixing portion 28*b*. Each fixing hole 28*c* passes through the fixing portion 28*b*, and serves to fasten the control eccentric shaft 29. Moreover, since an outer surface of the base portion 28*a* is in contact with the bottom surface of concave portion 24*b*, and respective outer edge surfaces of both fixing portions 28*b* and 28*b* are closely in contact with opposed inner surfaces of concave portion 24*b*, i.e., is fitted to and held by the opposed inner surfaces of concave portion 24*b*; an accuracy of positioning is enhanced relative to the longitudinal direction.

(An outer circumferential surface of) the control eccentric shaft 29 swingably supports the rocker arm 15 through the support hole 15*d* of tubular base portion 15*a* of rocker arm 15. An axial length L of the control eccentric shaft 29 is set to be approximately equal to a distance between the respective axially-outside surfaces (outer edge surfaces) of the both fixing portions 28*b* and 28*b* of bracket 28. The control eccentric shaft 29 is fixed to the both fixing portions 28*b* and 28*b*, e.g., by forcibly inserting both end portions of control eccentric shaft 29 respectively into the fixing holes 28*c* and 28*c*. A shaft center Q of the control eccentric shaft 29 serves as a swinging fulcrum of the rocker arm 15.

As shown in FIG. 2, axially-outside surfaces of the cam main body 5*a* of drive cam 5, axially-outside surfaces of the link rod 17 and axially-outside surfaces of the swing cam 7 exist within a range of the length L of control eccentric shaft 29, as viewed in a direction perpendicular to the axial direction of drive shaft 4.

As shown in FIGS. 4A to 4C, the shaft center Q of control eccentric shaft 29 is eccentric to (deviated from) a shaft center P of the control pivot shaft 24*a* by a relatively large eccentric amount a because of an arm length of each fixing portion 28*b* of bracket 28. In other words, the control eccentric shaft 29 is formed in a crank shape by use of the bracket 28 relative to the shaft center P of control pivot shaft 24*a*. Hence, the eccentric amount $\alpha$ can be set at a sufficiently large value.

The electric actuator includes an electric motor and a speed reducer (not shown). The electric motor is fixed to a rear end portion of the cylinder head 1. The speed reducer is, for example, a ball screw mechanism for transmitting a rotational drive force of the electric motor to the control pivot shaft 24*a*.

The electric motor is a proportional DC motor. This electric motor is driven by control signals that are outputted from the electronic controller 49 configured to detect the operating state of engine.

The electronic controller 49 detects the current operating state of engine, e.g., by calculations using the above-mentioned crank angle sensor for sensing the engine rotational speed, the air flow meter for sensing an amount of intake air, the water-temperature sensor for sensing a water temperature of the engine or the like. Moreover, the electronic controller 49 detects an operational position of the variable mechanism by receiving information signals derived from a potentiometer for sensing a rotational position of the control shaft 24, and the like. Thereby, the electronic controller 49 controls the electric motor by way of feedback control. Since such an electric actuator uses electricity, a prompt responsivity in change can be obtained irrespective of oil temperature of engine and the like.

The electric actuator controls the valve lift-amount characteristic and the working angle of the intake valve 3*a* continuously within a range from a minimum value of working angle to a maximum value of working angle, by controlling the rotational position of control pivot shaft 24*a* in accordance with the operating state of engine. That is, a positional relation among the shaft center P of control pivot shaft 24*a*, a shaft center R of the shaft portion 15*e* of rocker arm 15, a shaft center S of the pivotally-supporting pin 19 and the like is assigned (determined) in accordance with the rotational position of control pivot shaft 24*a*. Thereby, an opening timing of valve-lift characteristic is varied toward an advanced side when controlling the midpoint of working angle.

[Operations of Valve Control Apparatus in First Embodiment]

Figures 5A, 5B, 5C:
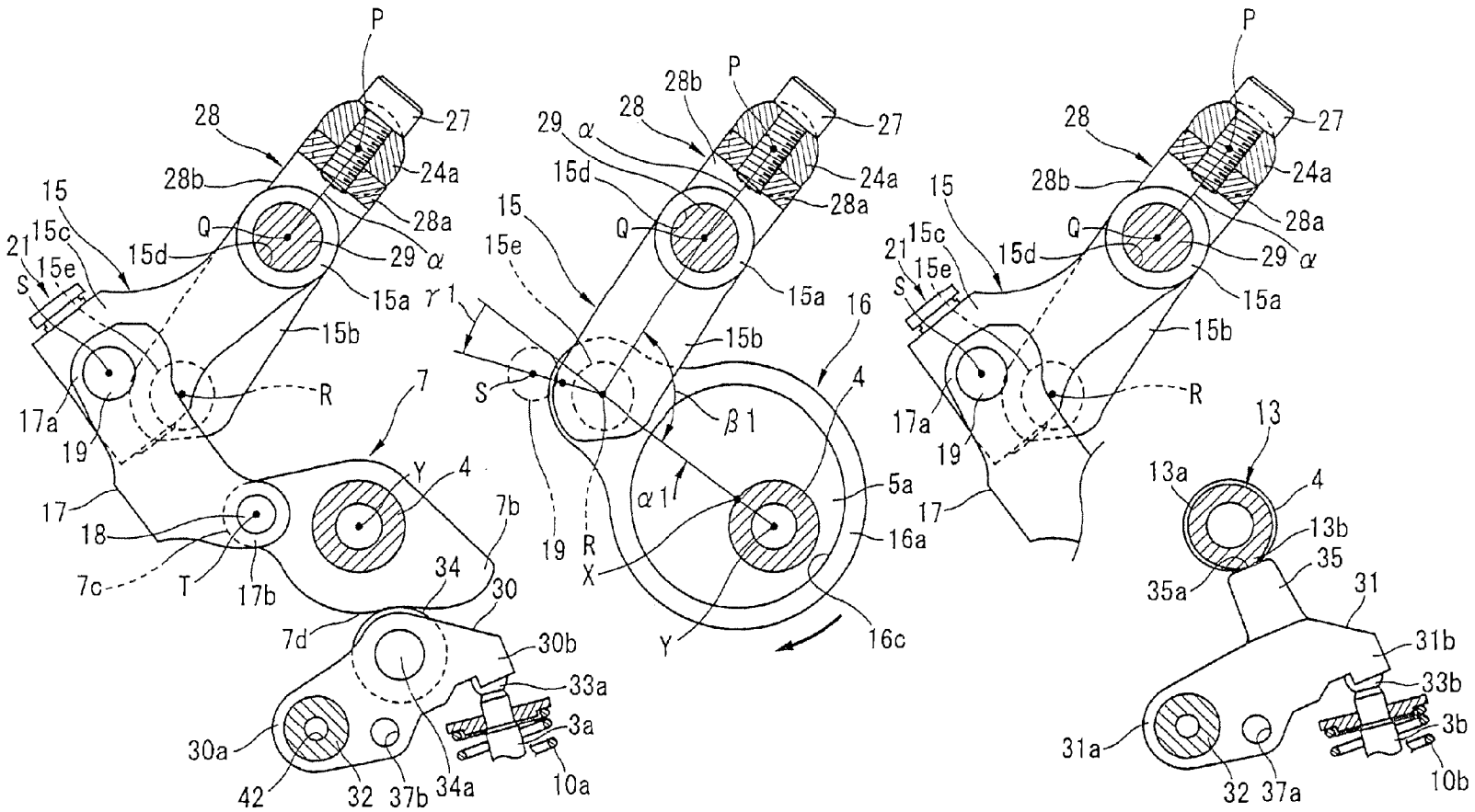
FIGS. 5A to 5C are cross sectional views under the minimum working angle.
Figures 6A, 6B, 6C:
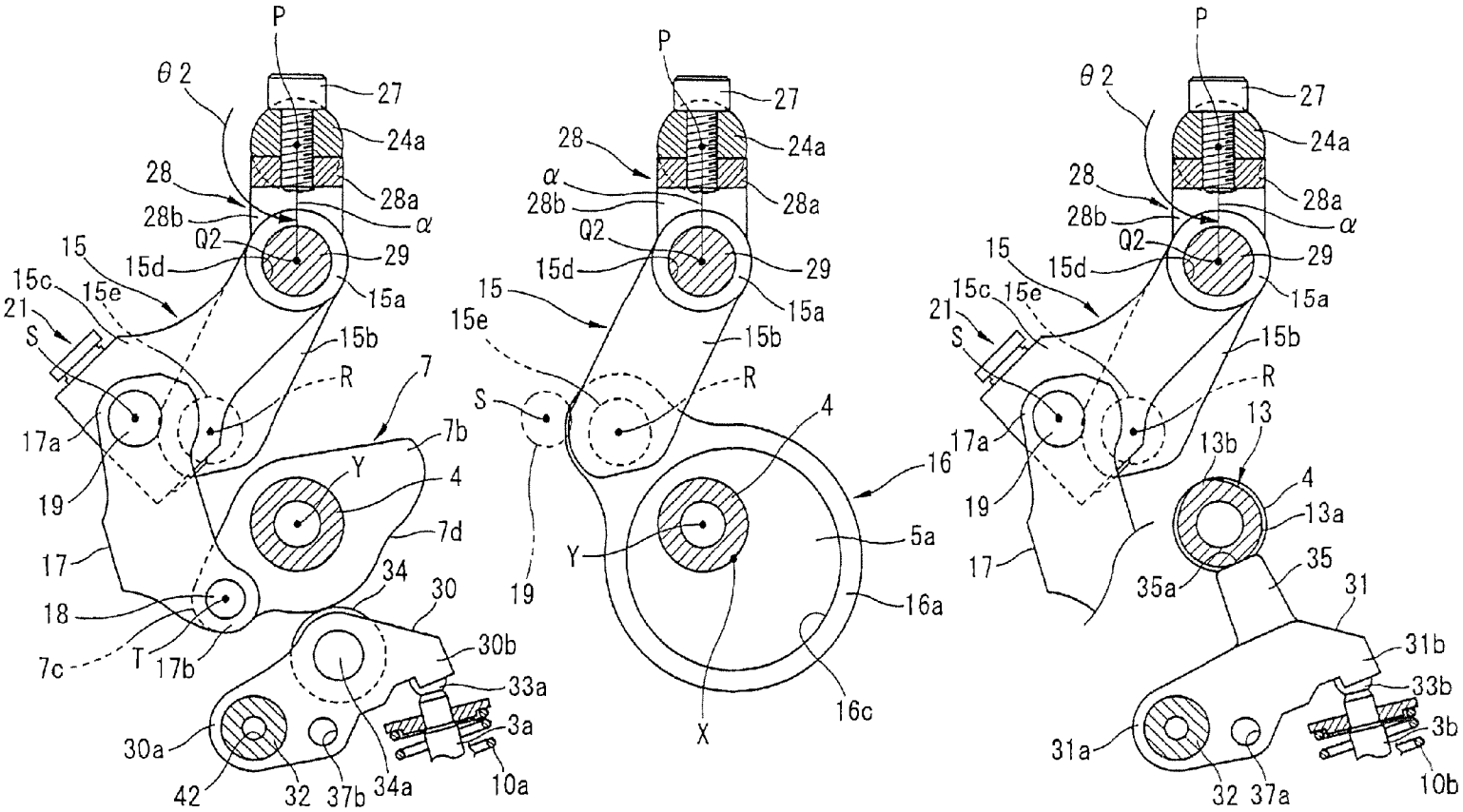
FIGS. 6A to 6C are cross sectional views under a middle working angle.
Figures 7A, 7B, 7C:
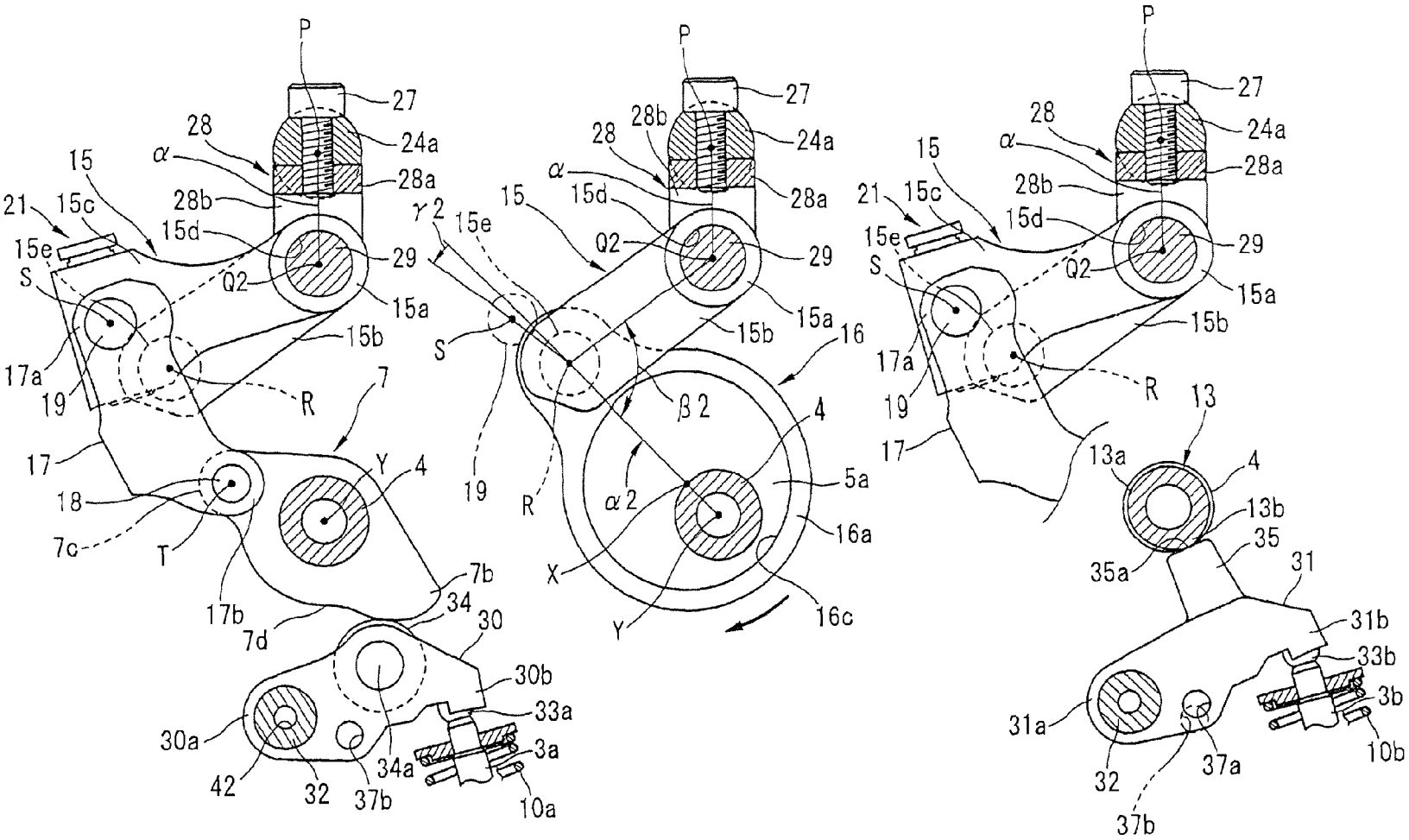
FIGS. 7A to 7C are cross sectional views under the middle working angle.
Figure 8A:
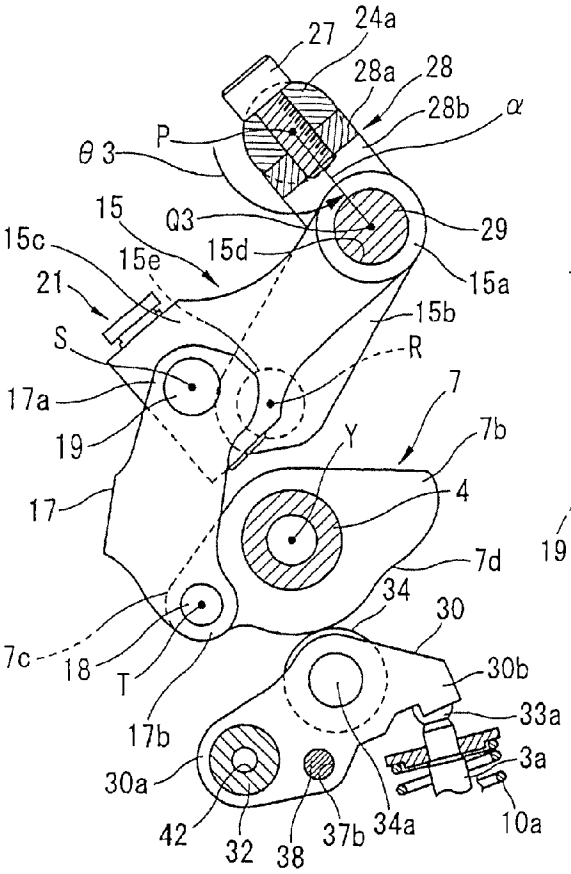
FIGS. 8A to 8C are cross sectional views under a maximum working angle.
Figure 8B:
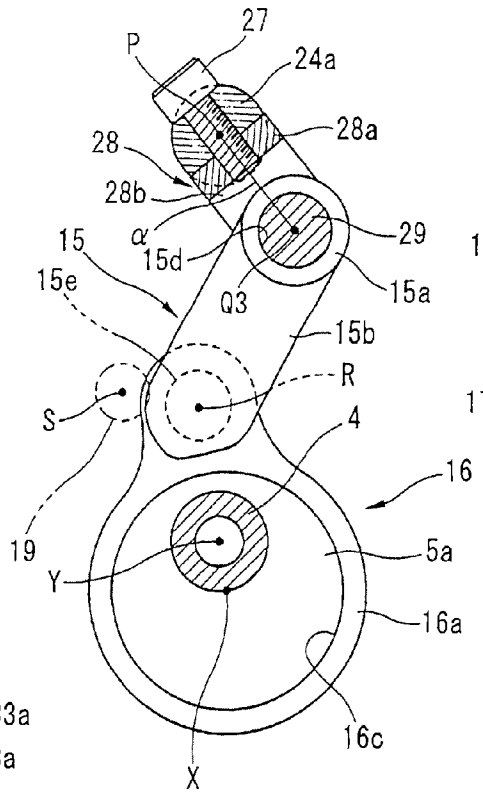
Figure 8C:
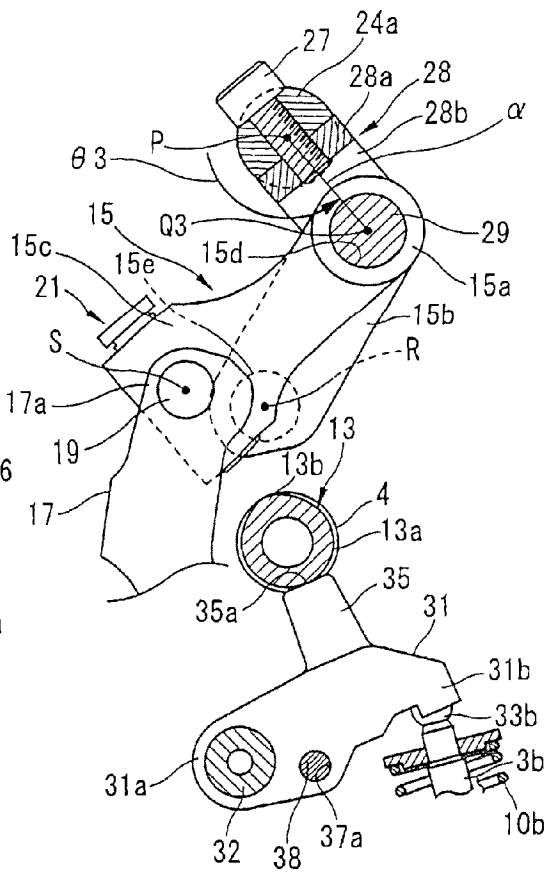
Figures 9A, 9B, 9C:
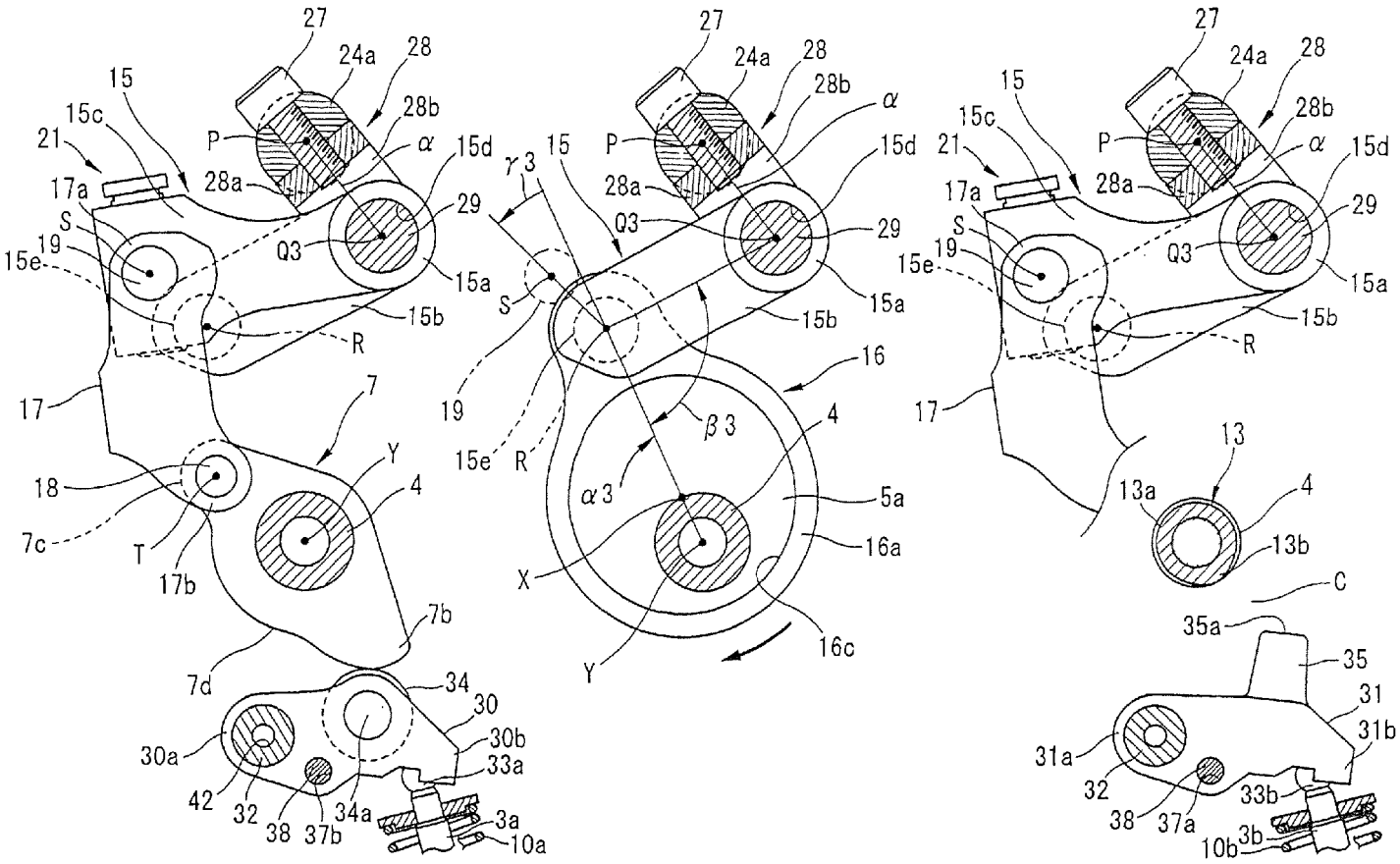
FIGS. 9A to 9C are cross sectional views under the maximum working angle.

Operations of the valve control apparatus according to the first embodiment will now be explained referring to FIGS. 4A to 9C. FIGS. 4A to 5C show a state where the intake valve has been controlled to have a minimum lift amount L1 (a minimum working angle D1), by the valve control apparatus. FIGS. 4A to 4C show attitudes when the intake valve is closed, and FIGS. 5A to 5C show attitudes when the intake valve is open. FIGS. 6A to 7C show a state where the intake valve has been controlled to have a middle lift amount L2 (a middle working angle D2), by the valve control apparatus. FIGS. 6A to 6C show attitudes when the intake valve is closed, and FIGS. 7A to 7C show attitudes when the intake valve is open. FIGS. 8A to 9C show a state where the intake valve has been controlled to have a maximum lift amount L3 (a maximum working angle D3), by the valve control apparatus. FIGS. 8A to 8C show attitudes when the intake valve is closed, and FIGS. 9A to 9C show attitudes when the intake valve is open.

At first, for example, at the time of low rotational speed of the engine such as idling operation or at the time of low load of the engine, the connection changeover mechanism 36 does not connect the second swing arm 31 with the first swing arm 30 in each cylinder. That is, the electronic controller 49 does not output the control signal to the electromagnetic changeover valve 48, so that the hydraulic-pressure supply/discharge passage 43 communicates with (i.e., is open to) the drain passage 47 and does not communicate with (i.e., is closed to) the supply passage 46. Hence, hydraulic pressure is not supplied to the pressure-receiving chamber 40. As shown in FIG. 2, whole of the connecting pin 38 is maintained at its backward position by spring force of the coil spring 39. That is, the connecting pin 38 is held within the first retaining hole 37*a* by the biasing force of the coil spring 39. Thereby, the first swing arm 30 is not interlocked with the second swing arm 31. Under this state, when the second drive cam 13 is lifting the second swing arm 31, the sip surface 35*a* of the slip convex portion 35 is in contact with the outer circumferential surface 13*a* of the second drive cam 13, so that the shim 33*b* of the second swing arm 31 is in contact with the stem end of the second intake valve 3*b* by the spring force of the valve spring 10*b*.

At this time, because of the output of control signal from the electronic controller 49 to the electric motor, the control pivot shaft 24*a* has been rotated to a counterclockwise-directional position θ1 by the ball screw mechanism, as shown in FIGS. 4A to 5C. Hence, the control eccentric shaft 29 has reached its position corresponding to the position θ1. The shaft center Q has moved away from the drive shaft 4 in an upper left direction of FIG. 4A. Thereby, whole of the transmission mechanism 8 has tilted around the drive shaft 4 in a counterclockwise direction. Hence, also the swing cam 7 has rotated in the counterclockwise direction so that a base-circular-surface side of the cam surface 7*d* is in contact with the roller 34 of the first swing arm 30.

When the rocker arm 15 is raised upwardly by the link arm 16 in response to the rotation of the drive cam 5 from the valve-closed state shown by FIG. 4A, the connecting portion 7*c* of swing cam 7 is lifted upwardly by the link rod 17 to rotate the swing cam 7 in the clockwise direction, as shown in FIG. 5A. This lift is transmitted through the roller 34 of the first swing arm 30 to the first intake valve 3*a*. Accordingly, the first intake valve 3*a* is lifted and then opened. However, at this time, both of the lift amount and working angle of the first intake valve 3*a* are sufficiently small. (minimum lift amount L1, minimum working angle D1)

Figure 10:
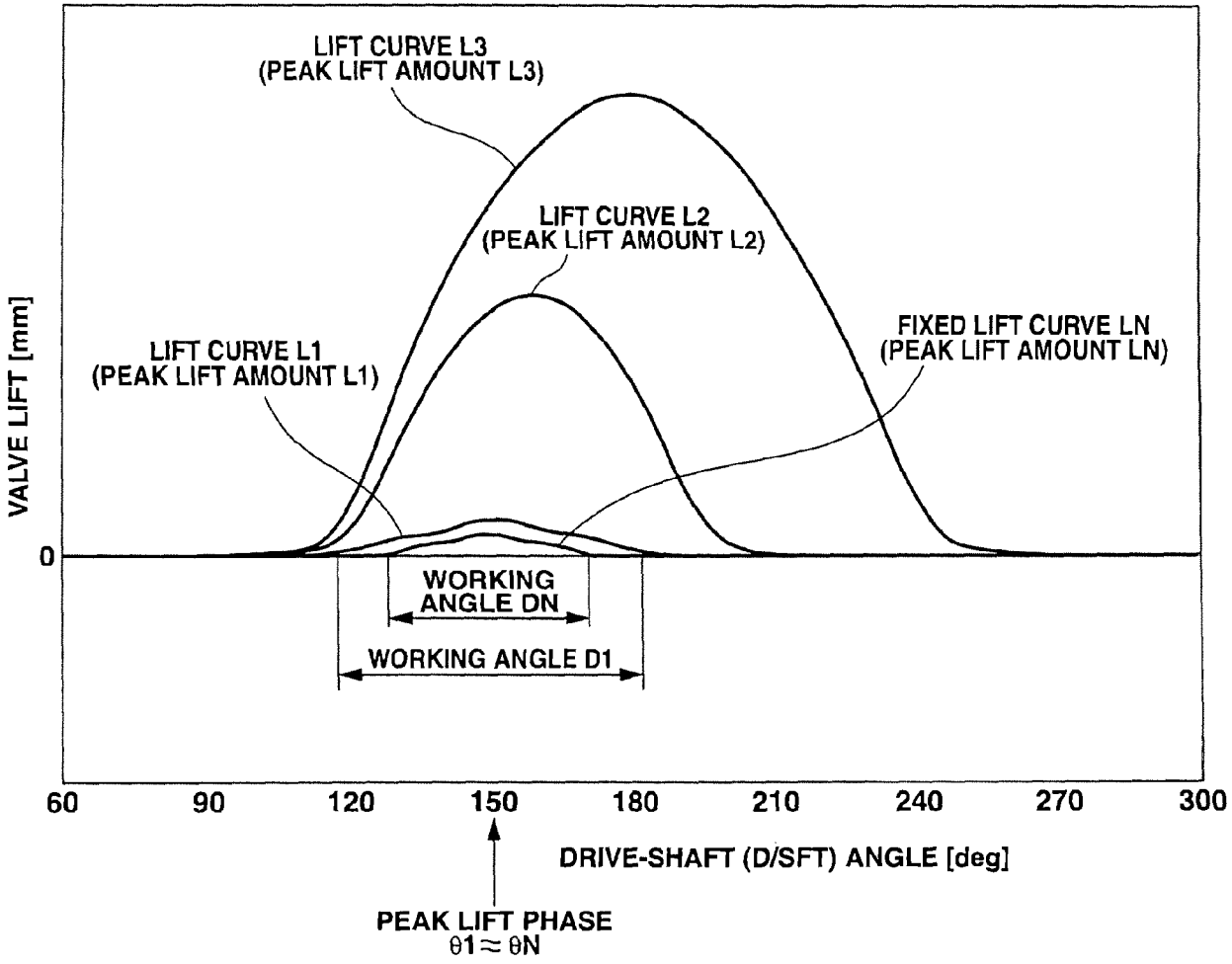
FIG. 10 is a valve-lift characteristic view of the first intake valve and the second intake valve in the first embodiment.

On the other hand, the sip surface 35*a* of the second swing arm 31 is constantly in contact with the outer circumferential surface 13*a* of the second drive cam 13. Hence, as shown in FIG. 4C, the second intake valve 3*b* becomes in the non-lifted state (closed state) when the rotational position of the second drive cam 13 falls within a base circle region over which the base circular portion of the second drive cam 13 is in contact with the slip convex portion 35. Then, when the rotational position of the second drive cam 13 falls within a lifted region over which the cam nose portion 13*b* of the second drive cam 13 is in contact with the slip convex portion 35, the second intake valve 3*b* becomes in the lifted state (open state) as shown in FIG. 5C. In such a low rotational speed or low load state of the engine, the second intake valve 3*b* attains a fixed lift curve having a peak lift amount equal to LN and a working angle equal to DN as shown in FIG. 10.

That is, during this control (during the low rotational speed or low load state of the engine), the lift curve L1 is realized by the first intake valve 3*a*, and the fixed lift curve LN is realized by the second intake valve 3*b*. As shown in FIG. 10, the peak lift amount LN of the second intake valve 3*b* is smaller than the minimum lift amount L1 of the first intake valve 3*a*. Also, the working angle DN of the second intake valve 3*b* is smaller than the minimum working angle D1 of the first intake valve 3*a*.

A peak lift phase θN of the second intake valve 3*b* is not deviated much from a peak lift phase θ1 of the first intake valve 3*a*, i.e., is substantially equal to the peak lift phase θ1. Accordingly, the lift curve LN is completely accommodated in (i.e., completely lower than) the lift curve L1 as shown in FIG. 10. As a result, if the connection changeover mechanism 36 connects the second swing arm 31 with the first swing arm 30 to lift the first and second intake valves 3*a* and 3*b* with an identical lift characteristic, these intake valves 3*a* and 3*b* are lifted reliably in dependence upon the lift curve L1 (by the first drive cam 5). In other words, in this case, the common lift characteristic of the connected intake valves 3*a* and 3*b* is not changed from the lift curve L1 (that is performed by the first drive cam 5) to the lift curve LN (that is performed by the second drive cam 13) during the lift operation.

Therefore, a noise generation can be avoided. Moreover, since the lift amount (LN) and the working angle (DN) of the second intake valve 3*b* are respectively smaller than the minimum lift amount (L1) and the minimum working angle (D1) in the control range of the first intake valve 3*a*, the minimum lift amount (L1) and the minimum working angle (D1) of the first intake valve 3*a* which are necessary for a certain gas exchange (a certain intake-air quantity) can be made relatively large. As a result, variation widths (L1~L3, D1~D3) of the lift amount and working angle of the first intake valve 3*a* can be made small. Thereby, an attitude variation of the control mechanism 9 can be reduced. Hence, a mountability to the engine can be improved. Moreover, a tight attitude (improper attitude) of the control mechanism 9 can be avoided, resulting in an enhancement in wear resistance of the control mechanism 9.

Next, a case where the state of engine has changed to a middle rotational speed region and/or a partial load region because of a steady-state running and the like of the vehicle will now be explained. In such a case, the connection changeover mechanism 36 still does not connect the second swing arm 31 with the first swing arm 30 in each cylinder.

In this case, the control shaft 24 has further rotated in the counterclockwise direction up to its position θ2 by the electric actuator on the basis of the control signal derived from the electronic controller 49 as shown in FIGS. 6A to 7C. Also, the control eccentric shaft 29 has rotated up to its position θ2. Thereby, the shaft center Q2 of the control eccentric shaft 29 has become closest (nearest) to the drive shaft 4.

Accordingly, whole of the transmission mechanism 8 including the rocker arm 15, the link arm 16 and the like has rotated around the drive shaft 4 in the clockwise direction. Hence, also the swing cam 7 has rotated relatively in the clockwise direction (lifting direction).

In this case, under a state shown by FIGS. 6A to 6C, the base circular surface of the swing cam 7 is in contact with the roller 34 so that the cam nose portion 7*b* faces in the upward direction (toward the control shaft 24). Hence, the first intake valve 3*a* is not lifted (i.e., in the closed state). Also the second intake valve 3*b* is not lifted (i.e., in the closed state), because the sip surface 35*a* is in contact with the base circular portion of the second drive cam 13 so that the cam nose portion 13*b* faces in the upward direction (toward the control shaft 24).

Then, as shown by FIGS. 7A to 7C, a movement of the cam nose portion 7*b* of the drive cam 7 is transmitted through the first swing arm 30 to the first intake valve 3*a*. Thereby, the first intake valve 3*a* is lifted. Thus, in the middle load region or the middle rotational speed region of the engine, the valve lift amount and the working angle of the first intake valve 3*a* are increased as shown in FIG. 10. Therefore, in this engine region, the middle lift amount L2 and the middle working angle D2 of the first intake valve 3*a* are obtained.

At this time, the cam nose portion 13*b* of the second drive cam 13 downwardly presses the sip surface 35*a* so as to lift and open the second intake valve 3*b*. In this case, the second intake valve 3*b* attains the fixed lift curve LN (having the peak lift amount equal to LN) as shown in FIG. 10. At a drive-shaft angle at which the first intake valve 3*a* takes its peak lift, the second intake valve 3*b* takes a lift amount value somewhat smaller than the peak lift amount LN, as shown in FIG. 10. In other words, a peak-lift phase of the first intake valve 3*a* is slightly retarded as compared with a peak-lift phase of the second intake valve 3*b*.

Next, a case where the state of engine has changed to a high rotational speed region or a high load region will now be explained. In such a case, the electromagnetic changeover valve 48 communicates the hydraulic-pressure supply/discharge passage 43 with the supply passage 46 and blocks the communication between the hydraulic-pressure supply/discharge passage 43 and the drain passage 47, by the signal outputted from the electronic controller 49. Thereby, high-pressure oil is supplied to the pressure-receiving chamber 40, so that the front-end portion 38*a* of the connecting pin 38 is inserted into the second retaining hole 37*b* so as to engage with the first swing arm 30 when the first swing arm 30 is not being lifted.

That is, at this time, the second swing arm 31 is in non-lifted state. Hence, when the first swing arm 30 is also in the non-lifted state, the first retaining hole 37*a* conforms to the second retaining hole 37*b*. Therefore, when both of the first and second swing arms 30 and 31 are in the non-lifted state, the connecting pin 38 moves in the right direction of FIG. 2 against the biasing force of coil spring 39 so that the front-end portion 38*a* enters the second retaining hole 37*b* to be engaged. Accordingly, the first swing arm 30 is integrally connected (interlocked) with the second swing arm 31, so that the first swing arm 30 repeats the lifting operation and its returning operation in synchronization with the second swing arm 31.

Under this case, the control pivot shaft 24*a* has rotated in the counterclockwise direction up to a position θ3 by the ball screw mechanism because the control signal has been outputted from the electronic controller 49 to the electric motor, as shown in FIGS. 8A to 9C. Hence, the control eccentric shaft 29 has reached its position corresponding to the position θ3. The shaft center Q has moved away from the drive shaft 4 in an upper right direction of FIG. 8A. Thereby, whole of the transmission mechanism 8 has tilted around the drive shaft 4 in the clockwise direction. Hence, also the swing cam 7 has rotated in the clockwise direction around the drive shaft 4, so that the contact point between the cam surface 7*d* and the roller 34 of the first swing arm 30 has approached a lift-surface side of cam surface 7*d*.

FIGS. 8A to 8C show attitudes of this case under the non-lifted state corresponding to the valve-closed state. As shown in FIG. 8A, the base circular surface of the swing cam 7 is in contact with the roller 34 so that the cam nose portion 7*b* faces in the upward direction (toward the control shaft 24). Hence, the first intake valve 3*a* is in the not-lifted state (i.e., in the closed state). Also the second intake valve 3*b* is in the not-lifted state (i.e., in the closed state), because the sip surface 35*a* is in contact with the base circular portion of the second drive cam 13 so that the cam nose portion 13*b* faces in the upward direction.

FIGS. 9A to 9C show attitudes of this case under a state where the first intake valve 3*a* is open. That is, FIGS. 9A to 9C show a moment when an eccentric direction Y-X of the first drive cam 5 (i.e., a direction from the shaft center Y of drive shaft 4 toward the center X of cam main body 5*a*) has just faced in an axis-distance direction of the link arm 16 (i.e., a direction from X toward R). At this time, as shown in FIG. 10, the first intake valve 3*a* takes the maximum peak lift amount L3, and realizes the maximum working angle D3.

As mentioned above, the two swing arms 30 and 31 operate integrally with each other because the connection changeover mechanism 3 has already connected the second swing arm 31 with the first swing arm 30. Hence, the second intake valve 3*b* takes the same lift curve as the first intake valve 3*a*. That is, as shown in FIG. 9C, a large clearance C exists between the cam nose portion 13*b* of the second drive cam 13 and the sip surface 35*a* of the second swing arm 31, and hence, the lift (rotation) of the cam nose portion 13*b* of the outer circumferential surface 13*a* of the second drive cam 13 is not transmitted to the second swing arm 31. Accordingly, in the same manner as the first intake valve 3*a*, the second intake valve 3*b* takes the maximum peak lift amount L3 and realizes the maximum working angle D3, in dependence upon the swinging motion of the first swing arm 30.

Next, advantageous effects in the first embodiment will now be explained from a viewpoint of a performance of the engine.

In the control condition of the minimum lift amount L1 (minimum working angle D1) as shown in FIGS. 4A to 5C, the first intake valve 3*a* takes the lift curve L1 whereas the second intake valve 3*b* takes the lift curve LN shown in FIG. 10. As mentioned above, this control condition is used in the low rotational-speed region of engine such as idling. Thus, by reducing the lift working angle D, a pumping loss is reduced while a friction is reduced, resulting in an improvement of fuel economy.

Moreover, the second intake valve 3*b* is made to take a lift amount and a working angle as small as possible. Thereby, a lift difference between the first and second intake valves 3*a* and 3*b* is enlarged so that a swirl effect is enhanced to improve a combustion of the engine. Accordingly, the fuel economy can be further improved.

If the lift or the working angle of the second intake valve 3*b* is set to be excessively small, there is the following risk. That is, it is easy for a deposit to adhere to a portion near a contact portion between a valve seat and an outer circumference of an umbrella portion of the second intake valve 3*b* when the second intake valve 3*b* is in the closed state. Specifically, a component derived from a reflowed mixture gas (air-fuel mixture) or EGR gas sticks to the portion near the contact portion and grows as the deposit when the second intake valve 3*b* is in the closed state.

In the first embodiment according to the present invention, when the second intake valve 3*b* opens, gas flows to the outer circumference of the umbrella portion at a high speed so that the deposit is broken up and removed.

This advantageous effect in the first embodiment becomes higher as the working angle of the second intake valve 3*b* becomes larger or as the lift amount of the second intake valve 3*b* becomes larger. However, if the working angle or lift amount of the second intake valve 3*b* is excessively large, the swirl effect which is caused by the lift difference between the first and second intake valves 3*a* and 3*b* is weak.

Therefore, working angle and lift amount which are the minimum necessary to enable the deposit removal are required. In the first embodiment according to the present invention, the lift curve LN which is performed by the second drive cam 13 is set at the predetermined fixed lift curve (only one lift curve). This predetermined fixed lift curve satisfies the deposit-removal requirement and also produces a sufficient swirl effect. Moreover, this lift curve LN for the second intake valve 3*b* does not vary even if the working angle or the peak lift amount of the first intake valve 3*a* varies. That is, the deposit removal and the enhancement of swirl can be stably maintained irrespective of the variation of the working angle or peak lift amount of the first intake valve 3*a*.

For example, in the control condition of the middle lift amount L2 (middle working angle D2) where the swing arms 30 and 31 have been not connected with each other as shown in FIGS. 6A to 7C, the second intake valve 3*a* performs a lift curve substantially identical with the lift curve LN. Also in this control condition, the deposit removal and the enhancement of swirl can be stably maintained.

In this control condition, i.e., in the partial-load region over which the load (or rotational speed) is higher than that of the idling operation, fuel consumption can be reduced by virtue of a combustion improvement obtained by the swirl effect.

In the operating condition that a required torque is high, an opening of a throttle valve (not shown) is increased. At the same time, the connection changeover mechanism 36 connects the second swing arm 31 with the first swing arm 30 as shown in FIGS. 8A to 9C. As a result, both of the first and second intake valves 3*a* and 3*b* are controlled with the maximum lift amount L3 (the maximum working angle D3). Thereby, the intake air quantity is increased, so that the torque (output) can be enhanced. Thus, the intake air quantity is increased in the high-torque region, and thereby, the combustion is improved. Therefore, in this condition, the swirl effect is not necessary.

Figure 11:
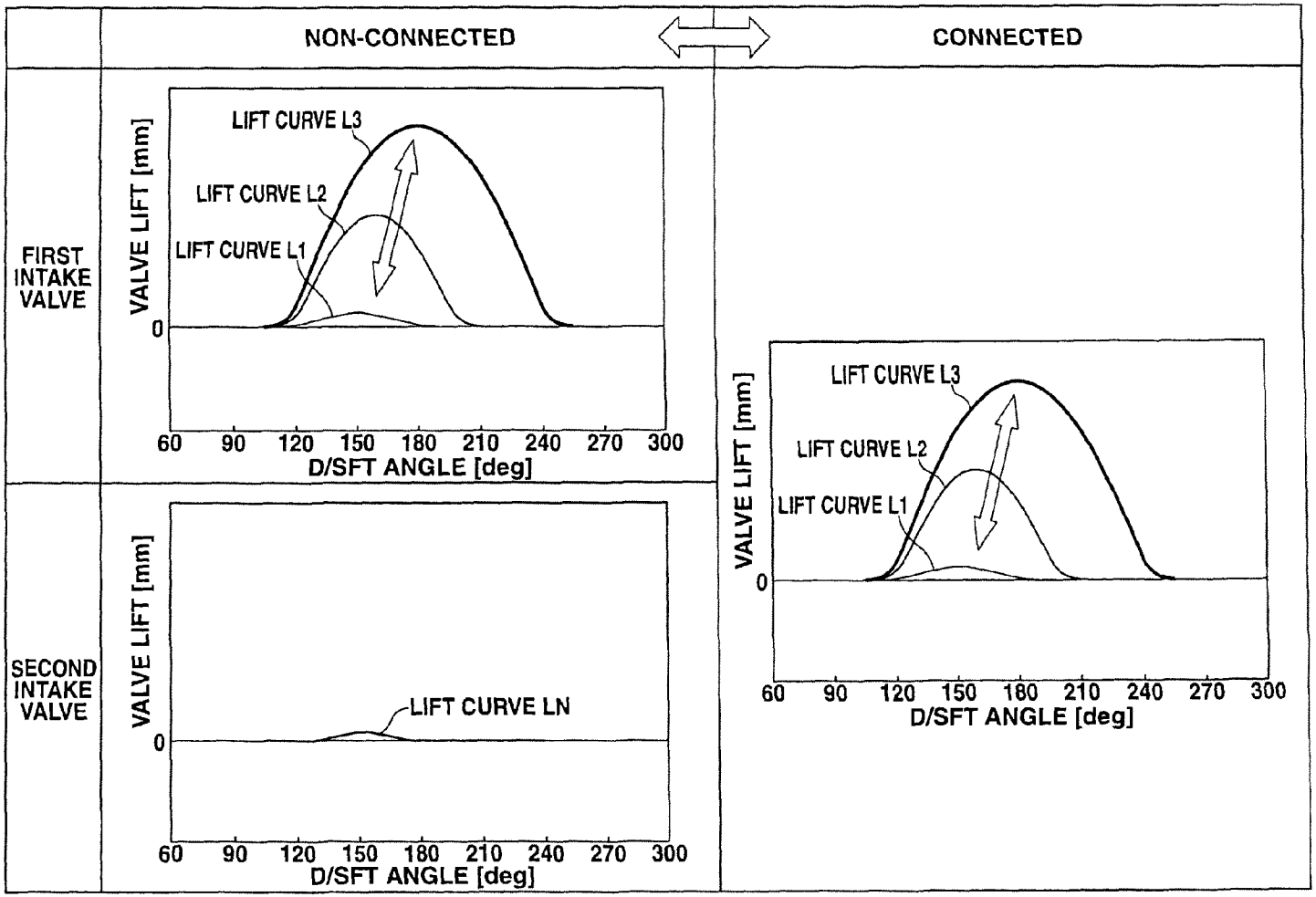
FIG. 11 is valve-lift characteristic views of the first and second intake valves when a connection changeover mechanism has connected both swing arms with each other and when the connection changeover mechanism has disconnected the swing arms from each other, in the first embodiment.

As shown by a lift characteristic view in a right side of FIG. 11, in the case where the first and second swing arms 30 and 31 are in the connected (interlocked) state by the connection changeover mechanism 36, both of the first and second intake valves 3*a* and 3*b* realize the same lift curve. In such a case, the common working angle of both the first and second intake valves 3*a* and 3*b* varies from the working angle D1 of the lift curve L1 having the peak lift amount L1 to the working angle D3 of the lift curve L3 having the peak lift amount L3. A maximum output power may be enhanced by making the working angle larger as the engine rotational speed becomes higher, and a very-low-rotation torque may be enhanced by making the working angle narrower as the engine rotational speed becomes lower.

Figure 12:
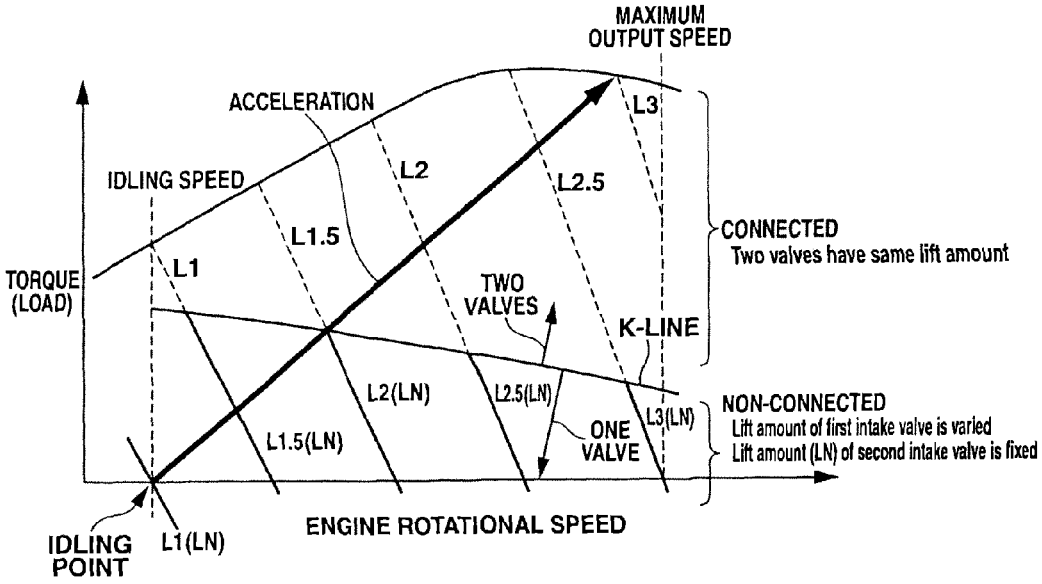
FIG. 12 is a control map for peak lift amounts of the first and second intake valves relative to a relation between load and rotational speed of the engine in the first embodiment.

FIG. 12 shows one example of a control map for the peak lift amounts of the first and second intake valves 3*a* and 3*b*.

The map of FIG. 12 has an X-axis of the engine rotational speed and a Y-axis of the engine torque (load). In a case that the torque is lower than a K-line of this map, the connection changeover mechanism 36 disconnects the second swing arm 31 from the first swing arm 30 so as to keep the lift difference between the first and second intake valves 3*a* and 3*b*. Accordingly, the combustion is improved by the swirl effect, resulting in the improvement of fuel economy.

On the other hand, in a case that the torque is higher than the K-line on the map of FIG. 12, the connection changeover mechanism 36 connects the second swing arm 31 with the first swing arm 30 so as to lift both the first and second intake valves 3*a* and 3*b* with a relatively large lift amount. Accordingly, the torque is increased.

As shown in FIG. 12, a torque (Y-axis) of the K-line decreases with the rise of the engine rotational speed (X-axis). That is, the connection changeover mechanism 36 connects the first and second swing arms 30 and 31 with each other in advance at the time of a lower torque as the engine rotational speed becomes higher, because a frequency at which the vehicle runs with high torque becomes higher as the engine rotational speed becomes higher. Thereby, the number of times the connection changeover mechanism 36 connects/disconnects the second swing arm 31 with/from the first swing arm 30 is reduced, and moreover, a frequency at which a time delay necessary for the connection/disconnection (i.e., switching) of the swing arms 30 and 31 occurs can be reduced. Accordingly, a smooth torque rise can be attained. Also, a frequency at which a torque shock occurs due to the connecting/disconnecting operation (switching operation) of the connection changeover mechanism 36 can be lowered.

If the lift amount of the second intake valve 3*b* is changed rapidly from the very-small lift LN to the large lift equal to that of the first intake valve 3*a* when an operating point of the engine exceeds the K-line, the above-mentioned torque shock occurs due to the rapid torque rise. Therefore, in the first embodiment according to the present invention, a transient lift control is performed as shown in FIG. 13.

Figure 13:
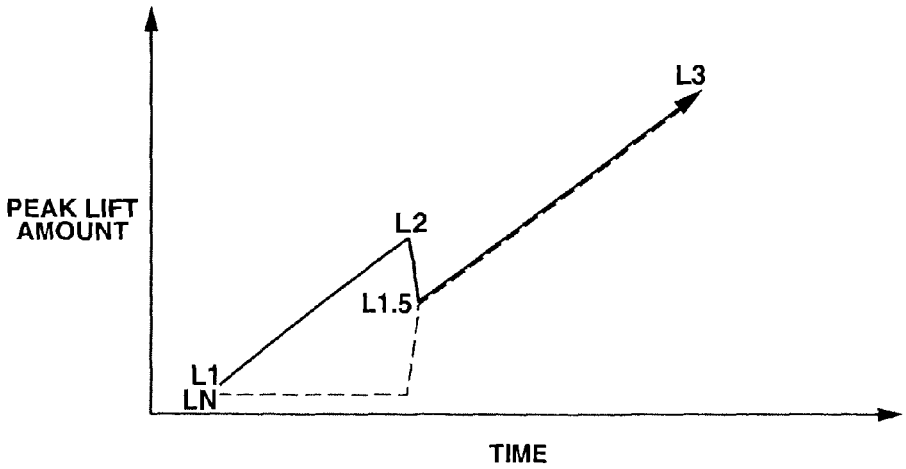
FIG. 13 is a characteristic view showing variations of the peak lift amounts of the first and second intake valves and also showing a process of changing from a non-connected state between both the swing arms to a connected state between both the swing arms at the time of acceleration, in the first embodiment.

FIG. 13 shows an example in which the vehicle accelerates from the idling. This example is also shown by a thick line of FIG. 12. A solid line of FIG. 13 represents a variation characteristic of the peak lift amount of the first intake valve 3*a*. A dotted line of FIG. 13 represents a variation characteristic of the peak lift amount of the second intake valve 3*b*. At first, the second intake valve 3*b* takes the very-small fixed peak lift LN whereas the first intake valve 3*a* takes the peak lift L1. Then, the first intake valve 3*a* gradually increases its peak lift amount with the increase of engine speed and the increase of engine load. Then, the operating point of the engine reaches the K-line at which the peak lift of the first intake valve 3*a* reaches the middle peak lift L2. At this time (on the K-line), if the connection changeover mechanism 36 connects the second swing arm 31 with the first swing arm 30, the peak lift of the second intake valve 3*b* sharply rises from the very-small lift LN to the middle lift L2 so that the air quantity is also rapidly increased. In this case, there is a risk that the torque rises sharply to cause the torque shock.

Therefore, in the first embodiment according to the present invention, concurrently when the connection changeover mechanism 36 connects the second swing arm 31 with the first swing arm 30, the common peak lift amount for the both intake valves 3*a* and 3*b* is changed from the lift amount L2 to a lift amount L1.5 as shown in FIG. 13 by rotating the control shaft 24 in one direction.

Thus, when the connection changeover mechanism 36 connects the second swing arm 31 with the first swing arm 30, both of the first and second intake valves 3*a* and 3*b* are made to take the valve lift amount L1.5. The valve lift amount L1.5 which is realized by both the first and second intake valves 3*a* and 3*b* produces a total torque substantially equal to that produced when the first intake valve 3*a* took the valve lift amount L2 and the second intake valve 3*b* took the valve lift amount LN. Hence, the torque shock due to torque level-difference as mentioned above is reduced or suppressed.

In the first embodiment, the example has been explained in which the valve control apparatus according to the present invention is applied to the first and second intake valves 3*a* and 3*b*. However, the valve control apparatus according to the present invention can be applied also to first and second exhaust valves.

That is, it is easy for a deposit of combustion gas to adhere to a portion near a contact portion between a valve seat and an outer circumference of an umbrella portion of the second exhaust valve when the second exhaust valve is in the closed state. This deposit can be removed by setting the lift characteristic of the second exhaust valve at the fixed very-small lift (curve) LN. Even if the lift amount characteristic of the first exhaust valve is varied, this lift curve LN for the second exhaust valve is not varied. Thereby, the deposit can be reliably removed.

Since the very-low lift LN of the second exhaust valve is maintained, combustion gas is mainly exhausted from the first exhaust valve. During an exhaust stroke, a gas flowing is strengthened within the cylinder so that a combustion stability in next combustion cycle is improved. Accordingly, the fuel consumption can be reduced. Moreover, since an exhaust gas flow to a downstream exhaust manifold and a catalyst is disturbed, a conversion performance of the catalyst is enhanced so that an exhaust emission can be reduced.

[Second Embodiment]

FIGS. 14 to 17 show a second embodiment according to the present invention. In the second embodiment, each of the first drive cam 5 and a second drive cam 50 is formed integrally with the drive shaft 4. Moreover, the swing cam 7 including the cam shaft 7*a* is formed such that the swing cam 7 can be divided (separated) into two pieces via its base end portion (located between the connecting portion 7*c* and the cam nose portion 7*b*). Hence, the cam shaft 7*a* of the swing cam 7 is also dividable.

That is, both of the first drive cam 5 and the second drive cam 50 are formed integrally with the drive shaft 4 when the drive shaft is molded by casting, forging or the like. This second drive cam 50 is formed as a large oval cam (large egg-shaped cam) as compared with the second drive cam 13 of the first embodiment.

Because the first and second drive cams 5 and 50 are molded integrally with the drive shaft 4 as mentioned above, the drive shaft 4 cannot be inserted sequentially into the plurality of swing cams 7 from the end portion of the drive shaft 4 due to the existence of the drive cams 5 and 50 when trying to mount the swing cams 7 on the drive shaft 4. Hence, the swing cam 7 which has the shape of the first embodiment cannot be attached to the drive shaft 4 of the second embodiment.

Figure 14:
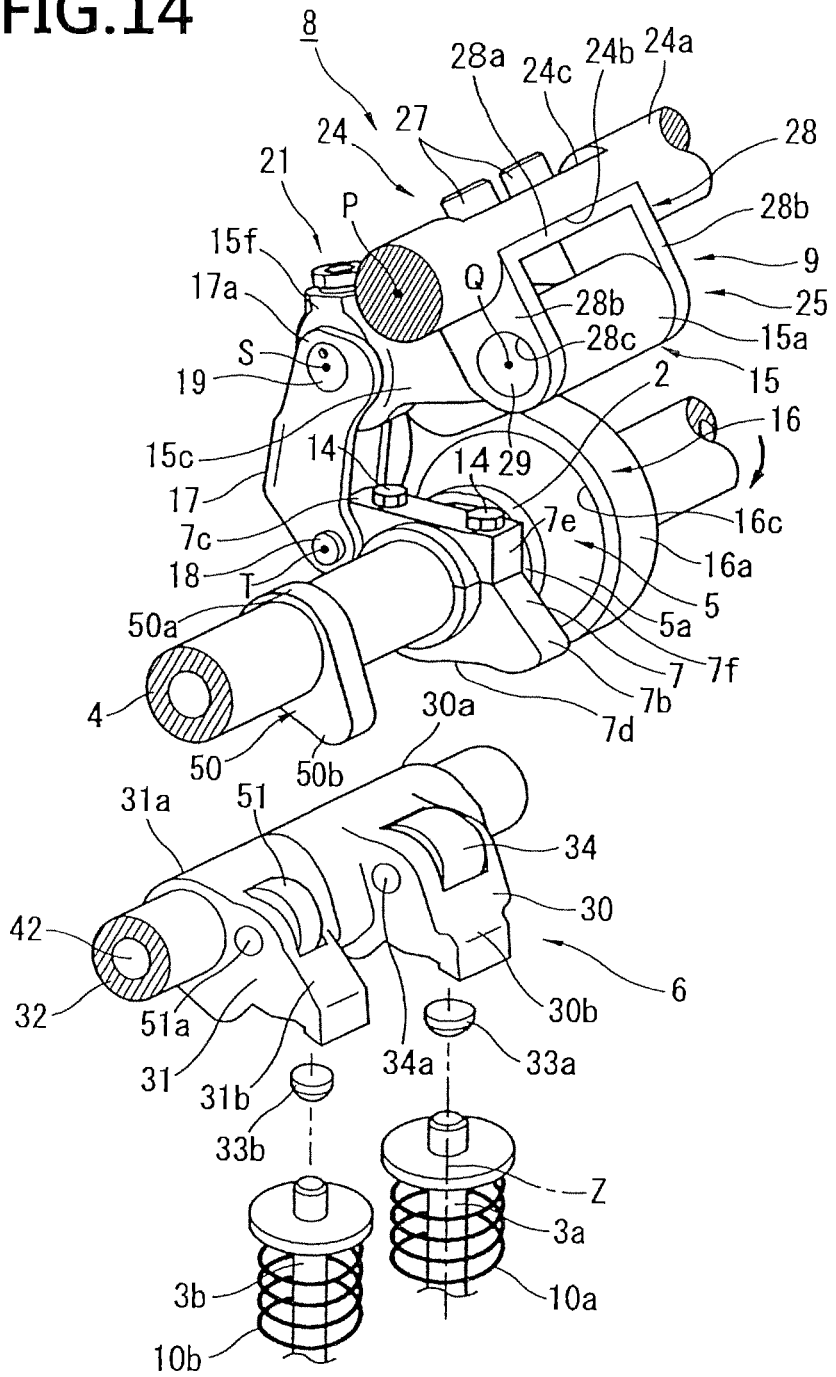
FIG. 14 is an exploded oblique-perspective view showing main parts of a valve control apparatus in a second embodiment according to the present invention.

Therefore, in the second embodiment, as shown in FIG. 14, the swing cam 7 is formed as two separate pieces of a cam main body and a bracket member 7*e*. These cam main body and the bracket member 7*e* are dividable at the base end portion side of the swing cam 7 (located between the connecting portion 7*c* and the cam nose portion 7*b*). The cam main body has the cam surface 7*d*. Each of these cam main body and bracket member 7*e* includes a bearing groove formed in a half-round shape. The bearing grooves are fitted over the drive shaft 4 from a radially outside of the drive shaft 4 so as to face each other, and under this state, the bracket member 7*e* is combined with the cam main body by using two bolts 14 and 14.

As mentioned above, since the first and second drive cams 5 and 50 are provided integrally with the drive shaft 4, a support stiffness of each of the first and second drive cams 5 and 50 becomes high so that a lift behavior can be stabilized. Moreover, because the fixing pin 12 as mentioned in the first embodiment is unnecessary, the number of components and the cost of manufacturing can be reduced.

Figure 15:
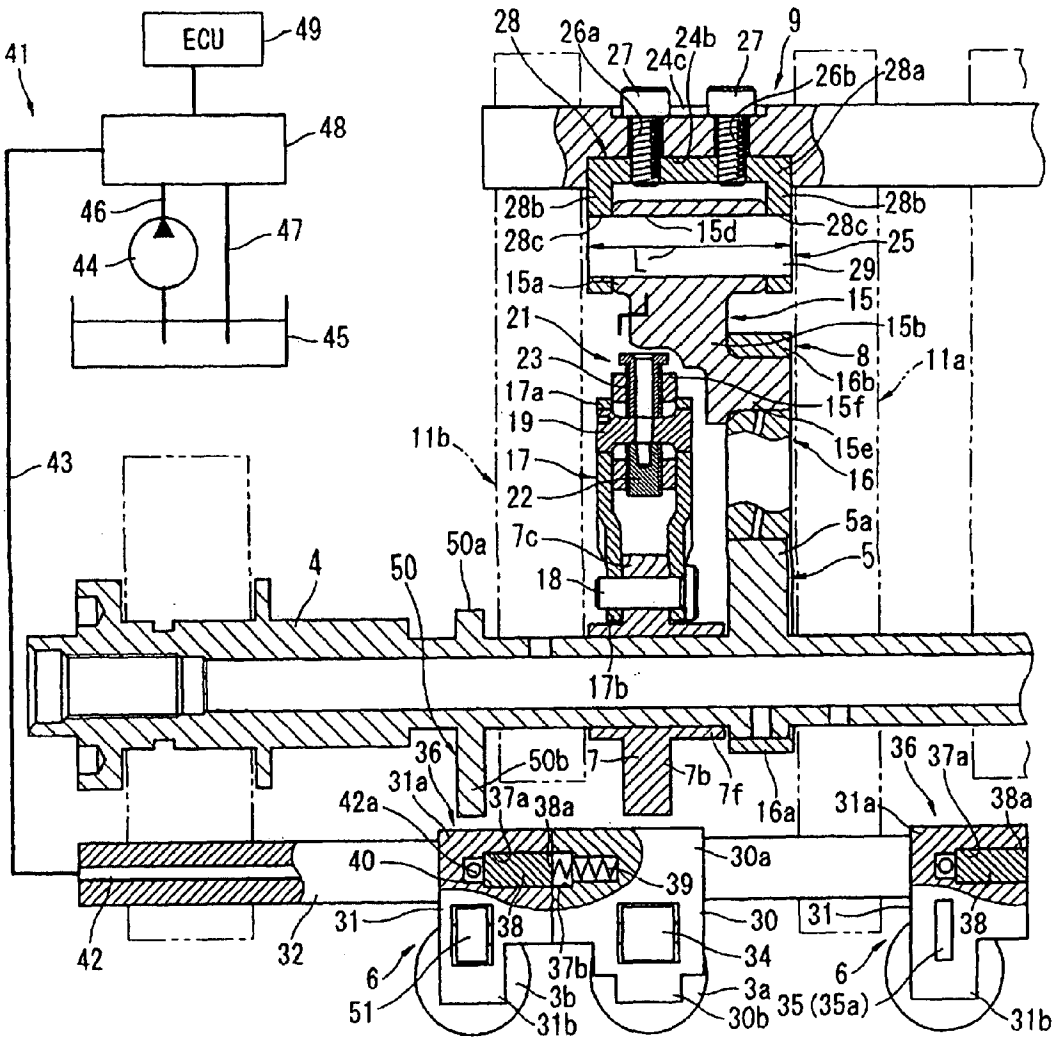
FIG. 15 is a cross sectional view of the main parts of the valve control apparatus in the second embodiment.

Moreover, as shown in FIGS. 14 and 15, one end portion of the cam shaft 7*a* of the swing cam 7 which is located on the side of the first drive cam 5 is formed to extend in the axial direction. A front edge of this extension portion 7*f* is located near one lateral surface of the first drive cam 5. Thus, by providing the extension portion 7*f*, the fall of swing cam 7 in the axial direction can be suppressed during its swinging motion. Moreover, by removing a sleeve 2 which is provided in the first embodiment, the number of components can be reduced.

The link rod 16 is mounted by inserting the drive shaft 4 into the link rod 16 in the axial direction, i.e., from the lateral direction.

In the second embodiment, a second roller 51 is rotatably supported by a second roller shaft 51*a* at a substantially center portion of the second swing arm 31 relative to a longitudinal direction of the second swing arm 31. Hence, an outer circumferential surface 50*a* of the second drive cam 50 is rotatably in contact with the second roller 51, instead of the slip surface of the first embodiment. This structure is given for the purpose of suppressing an increase of friction loss because the second drive cam 50 is enabled to produce a relatively high lift.

Accordingly, in the second embodiment, for example, under the unconnected state where the connection changeover mechanism 36 has not yet connected the second swing arm 31 with the first swing arm 30 in a predetermined rotational-speed region of the engine, the first roller 34 is rotatably in contact with the cam surface 7*d* of the swing cam 7 so as to lift (open) the first intake valve 3*a*. Thereby, the lift amount L and the working angle D of the first intake valve 3*a* vary between the lift curve characteristics L1 to L3 of FIG. 17. On the other hand, under this state, the second intake valve 3*b* always take a fixed lift curve depending on a cam profile of the second drive cam 50. This fixed lift curve is shown by a lift curve LN of FIG. 17 which has a peak lift amount LN and a working angle DN.

Figures 16A, 16B, 16C:
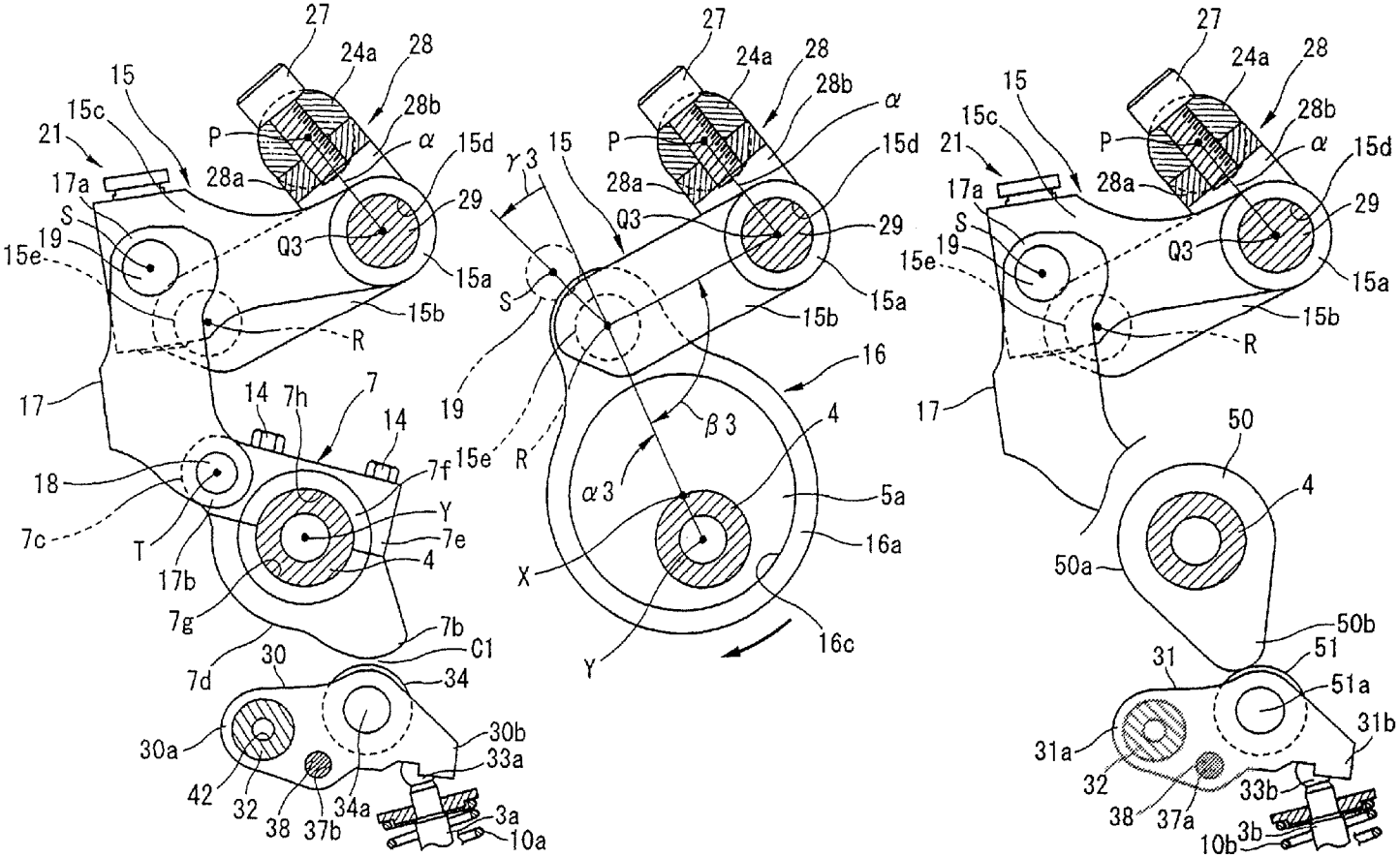
FIGS. 16A to 16C are cross sectional views under a maximum lift-amount control for the first and second intake valves by a cam profile of second drive cam in a situation that both the swing arms have been connected with each other, in the second embodiment.

Then, when the connection changeover mechanism 36 connects the first swing arm 30 with the second swing arm 31 in a high speed region of the engine or the like, the lifts of the intake valves 3*a* and 3*b* are controlled by the cam profile of the second drive cam 50 which can produce a large lift, as shown in FIGS. 16A to 16C. Thereby, a clearance C1 is given between the cam surface 7*d* of the swing cam 7 and the first roller 34 as shown in FIG. 16A, so that the first intake valve 3*a* opens in dependence upon the lift amount of the second drive cam 50, together with the second intake valve 3*b*.

Figure 17:
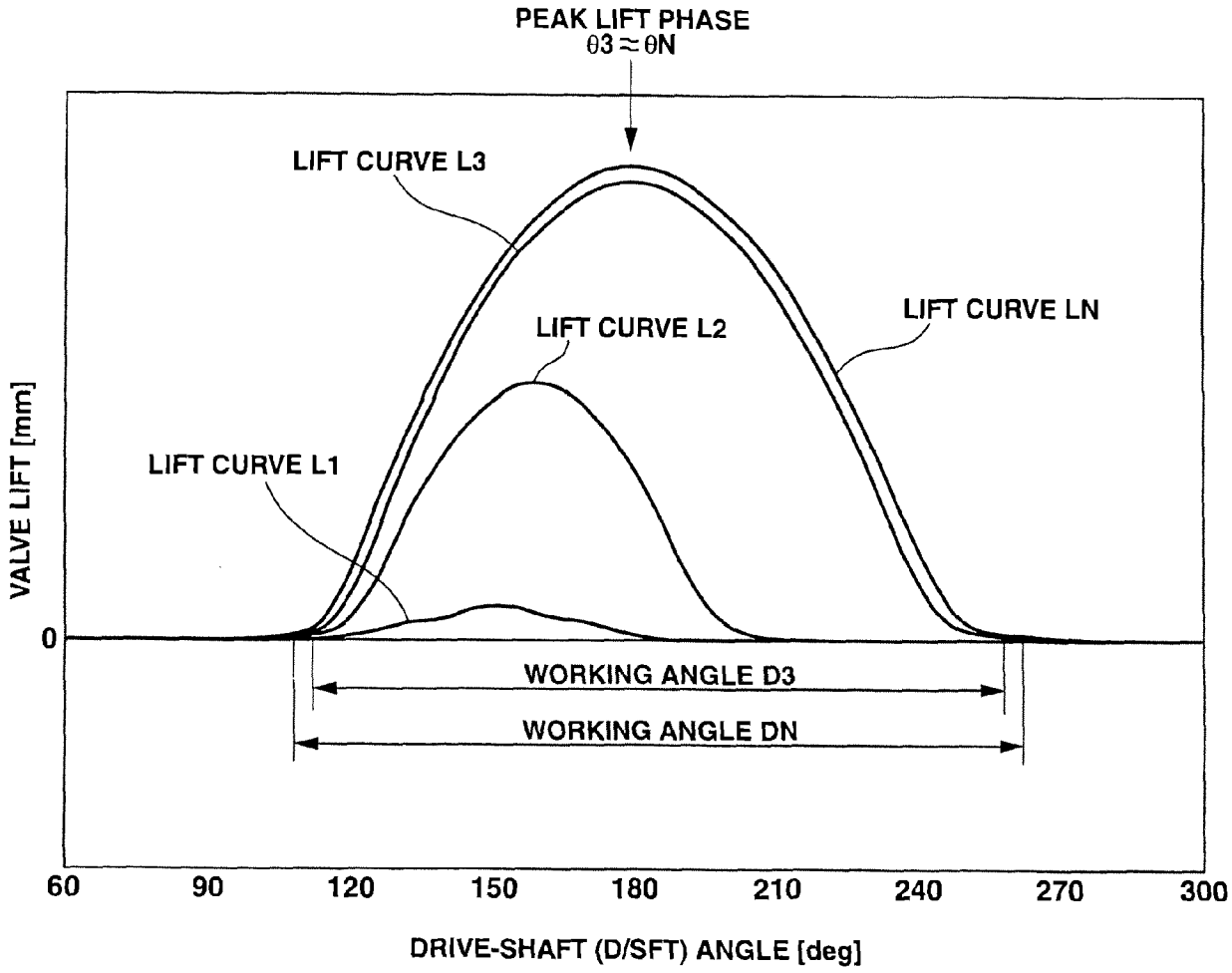
FIG. 17 is a valve-lift characteristic view of the first intake valve and the second intake valve in a situation that both the swing arms have been disconnected from each other in the second embodiment.

That is, as show in FIG. 17, the lift amount LN and the working angle DN of the second intake valve 3*b* are respectively larger than the maximum lift amount L3 and the maximum working angle D3 of the first intake valve 3*a* which are controlled by the cam surface 7*d* of the swing cam 7. Accordingly, when the connection changeover mechanism 36 has already connected the first swing arm 30 with the second swing arm 31, both of the first and second intake valves 3*a* and 3*b* are driven by the lift curve LN which is performed by the second drive cam 50.

Figure 18:
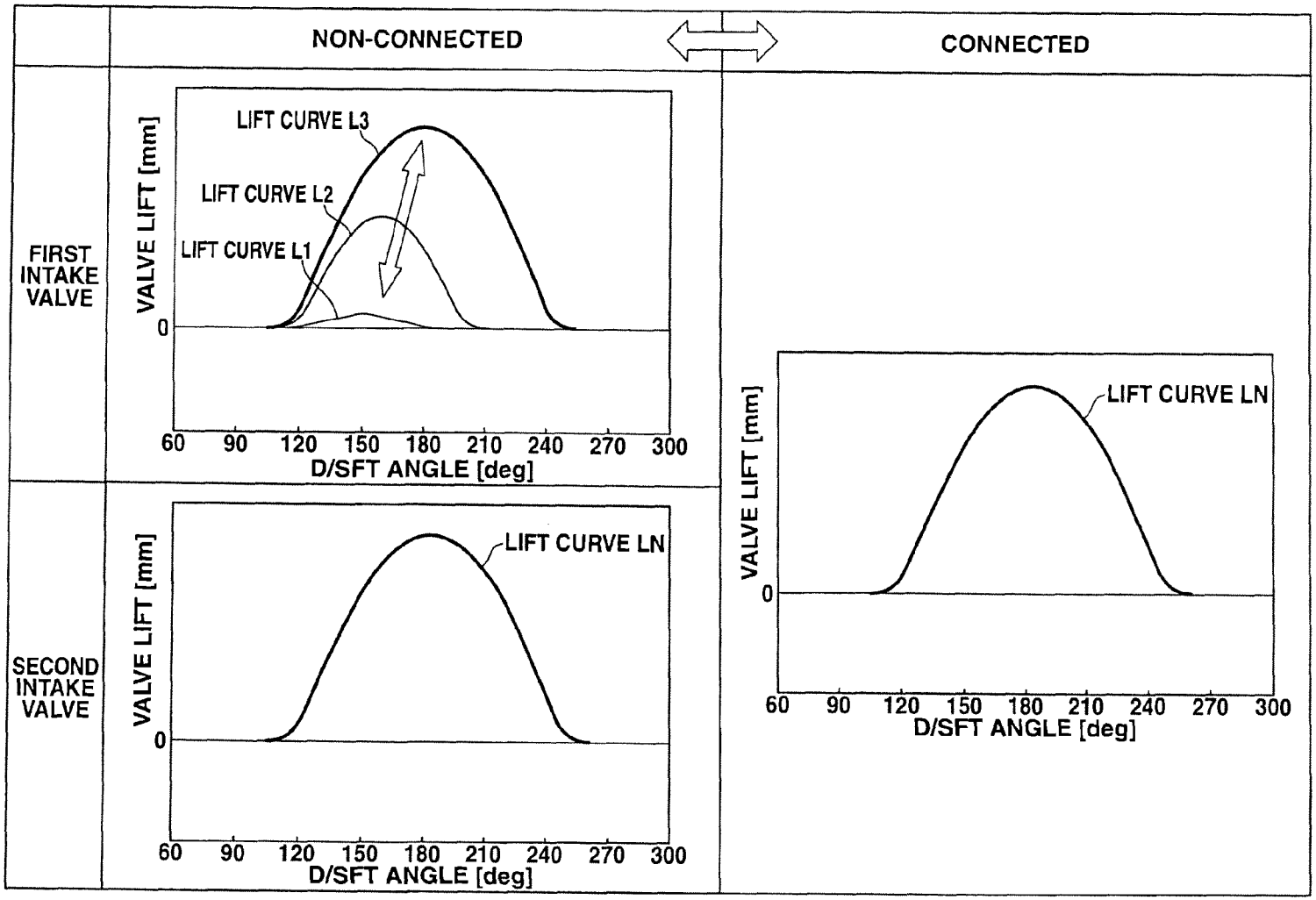
FIG. 18 is valve-lift characteristic views of the first and second intake valves when the connection changeover mechanism has connected both the swing arms with each other and when the connection changeover mechanism has disconnected the swing arms from each other, in the second embodiment.

FIG. 18 show a summary of the lift characteristics of the first and second intake valves 3*a* and 3*b* in the second embodiment. As seen from FIG. 18, the second intake valve 3*b* constantly operates (opens) with the large lift amount LN and the large working angle DN. Accordingly, torque can be increased only by opening the throttle valve (not shown), so that a rising responsivity of torque is enhanced.

Contrary to this, in the case of the first embodiment, when a sudden acceleration is required under a running state where the first intake valve 3*a* is operating with the small working angle L1 and the second intake valve 3*b* is operating with the very-small working angle LN, it is necessary to increase the working angle and also connect the first and second swing arms 30 and 31 with each other in order to increase torque. By that much, the torque generation needs time.

In the second embodiment, the lift amount LN of the second intake valve 3*b* when the connection changeover mechanism 36 is in the released state is larger than the maximum lift amount L3 which is obtainable within the control lift range of the first intake valve 3*a*. Moreover, the working angle DN of the second intake valve 3*b* when the connection changeover mechanism 36 is in the released state is larger than the maximum working angle D3 which is obtainable within the control lift range of the first intake valve 3*a*.

Therefore, when the first and second swing arms 30 and 31 have been connected with each other by the connection changeover mechanism 36, any of the first and second intake valves 3*a* and 3*b* can be prevented from being partially driven by the first drive cam 5 during the lifting operation. That is, the drive by the second drive cam 50 can be prevented from being changed into the drive by the first drive cam 5. Hence, noise can be reduced.

Moreover, since the lift amount LN and the working angle DN of the second intake valve 3*b* are larger than the maximum lift amount L3 and the maximum working angle D3 which are obtainable within the control range of the first intake valve 3*a* by the first drive cam 5, the maximum lift amount D3 and the maximum working angle D3 of the first intake valve 3*a* which are necessary for a certain gas exchange can be set at relatively small values. As a result, the variation widths (L1~L3, D1~D3) of the lift amount and working angle of the first intake valve 3*a* can be made small, so that an attitude change of the transmission mechanism 8 can be suppressed. Accordingly, the mountability to the engine and the like can be improved. Moreover, the transmission mechanism 8 can be inhibited from being forced to take a tight attitude (improper attitude), so that wear and abrasion resistance of the transmission mechanism 8 can be enhanced.

In the second embodiment, the example has been explained in which the valve control apparatus according to the present invention is applied to the intake valves. However, the valve control apparatus according to the present invention can be applied also to exhaust valves. In such a case, peak lift amount and working angle of one of the exhaust valves are varied whereas peak lift amount and working angle of another of the exhaust valves are fixed relative to the load and rotational speed of the engine. These fixed peak lift amount and fixed working angle of the another of the exhaust valves are respectively larger than the peak lift amount and working angle of the one of the exhaust valves. That is, the another of the exhaust valves realizes a fixed lift curve having the fixed peak lift amount and the fixed working angle. Accordingly, in the same manner as the above example in the second embodiment, the noise reduction and the variation-width reduction in lift amount and working angle can be attained.

[Third Embodiment]

Figures 19A, 19B, 19C:
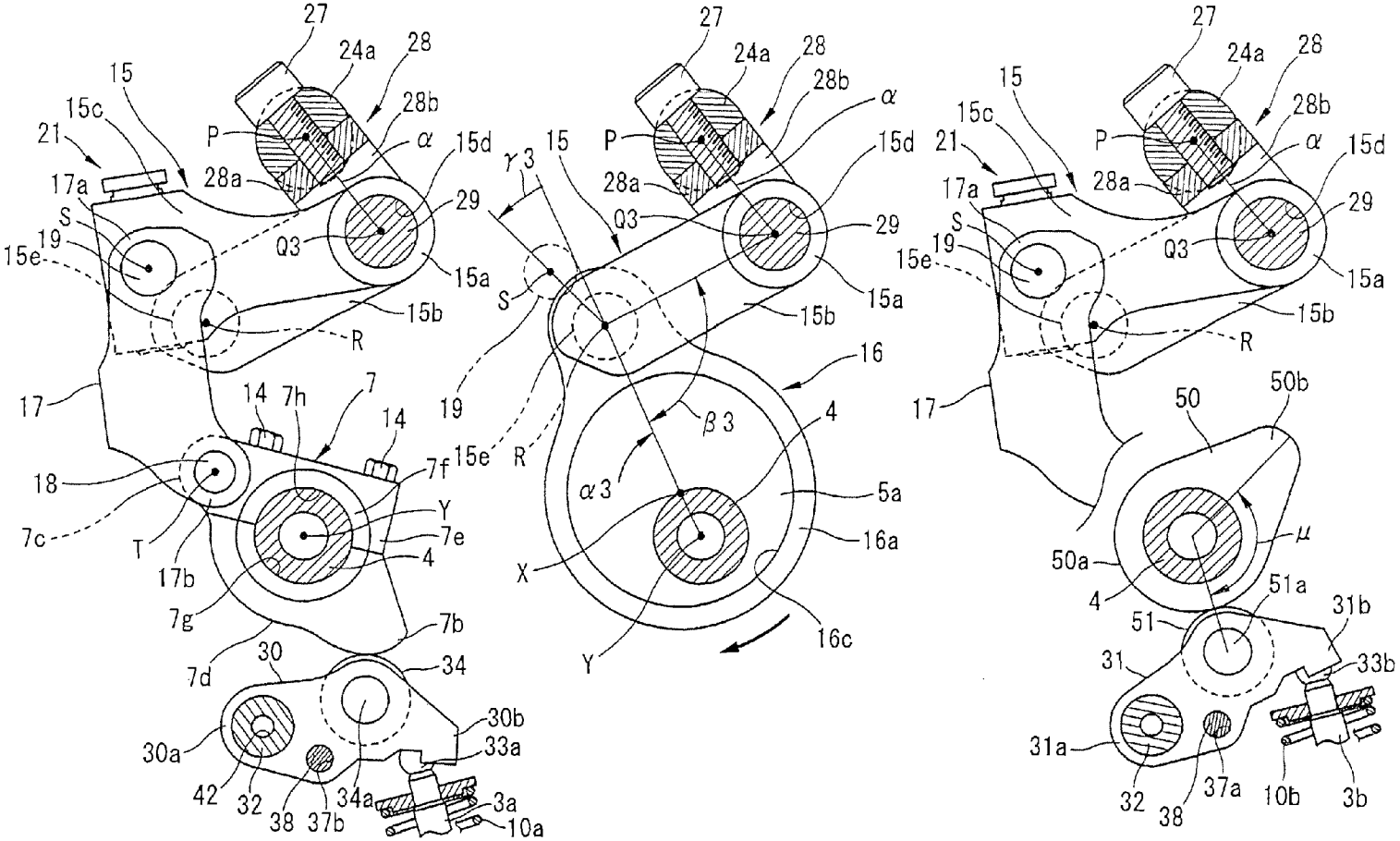
FIGS. 19A to 19C are cross sectional views showing operating states of the first and second intake valves in the situation that both the swing arms have been disconnected from each other, in a third embodiment according to the present invention.

FIGS. 19A to 19C show a third embodiment according to the present invention. A basic structure of the valve control apparatus of the third embodiment is the same as the second embodiment. However, in the third embodiment, the first intake valve 3*a* opens and closes during the exhaust stroke whereas the second intake valve 3*b* opens and closes during an intake stroke as usual. That is, the first drive cam is fixed (fastened) to the drive shaft 4 at a relatively phase-advanced position. Contrary to this, the second drive cam is fixed to the drive shaft 4 at a relatively phase-retarded position.

FIGS. 19A to 19C show attitudes at a moment when the peak lift of the first intake valve 3*a* just takes the value L3 under the state where the first intake valve 3*a* is being controlled by the lift curve L3 in the unconnected state of the connection changeover mechanism 36. At this moment, as shown in FIG. 19C, the second intake valve 3*b* is in the non-lifted state (closed state) because the second drive cam 50 is fixed to the drive shaft 4 at its position retarded in phase largely by μ in the counterclockwise direction.

Figure 20:
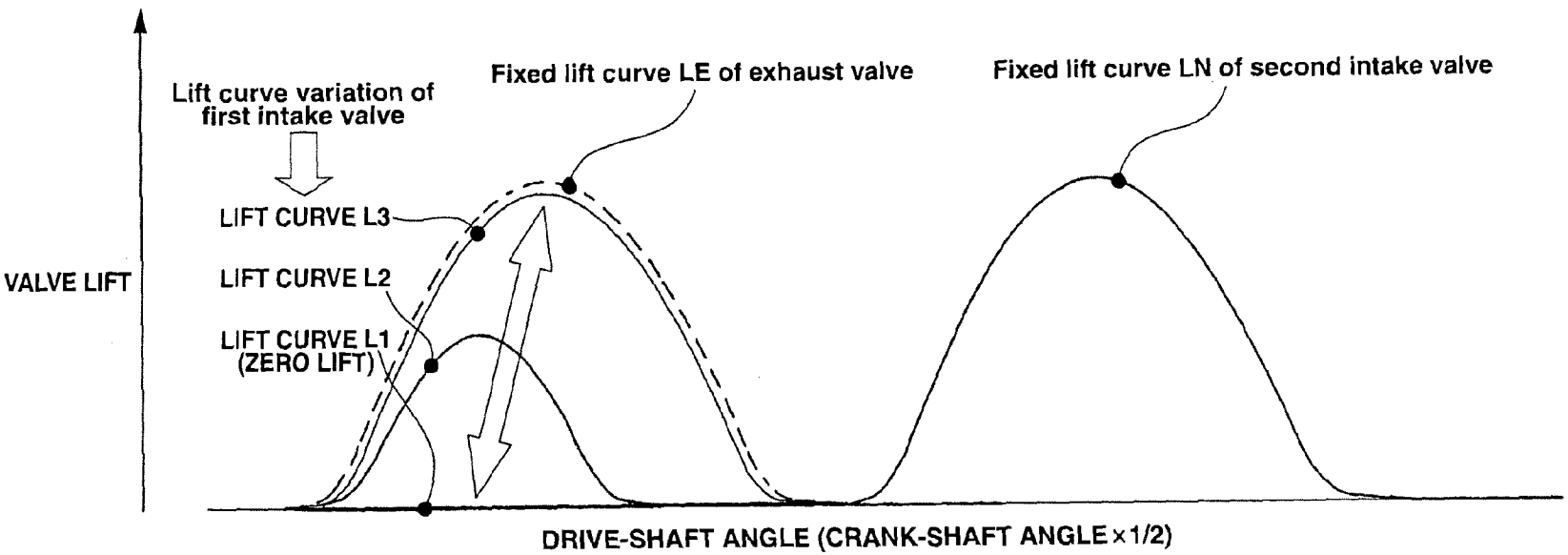
FIG. 20 is a valve-lift characteristic view of the first intake valve and the second intake valve in a situation that both the swing arms have been disconnected from each other in the third embodiment.

Then, when the drive shaft 4 has just rotated by μ in phase, the second intake valve 3*b* takes the peak lift amount LN by means of the second drive cam 50. Hence, as shown in FIG. 20 and a left part of 21, the fixed lift curve LN of the second intake valve 3*b* starts (i.e., has positive values) after the lift curve L3 of the first intake valve 3*a* ends (i.e., becomes zero).

The lift curve L3 of the first intake valve 3*a* may be set to be included in (i.e., to be entirely smaller than) a lift curve of each of two exhaust valves provided in every cylinder. This lift curve of each exhaust valve is shown by a dotted line in FIG. 20 or FIG. 21. In such a case, the lift (opening action) of the first intake valve 3*a* starts after a lift (opening action) of each exhaust valve started. Then, the lift (open state) of the first intake valve 3*a* ends before the lift (open state) of each exhaust valve ends. Therefore, exhaust gas (EGR gas) can be prevented from flowing at high pressure back to the intake side to cause a suction noise.

In the third embodiment, the minimum lift curve L1 of the first intake valve 3*a* is set to be constantly equal to 0, i.e., is set not to lift the first intake valve 3*a*. This minimum lift curve L1 can be easily set by changing the position in phase of the control shaft 24 in the more clockwise direction in FIGS. 19A to 19C, or alternatively by causing a cam protruding shape of the swing cam 7 to be lower than that of the first embodiment.

Figure 21:
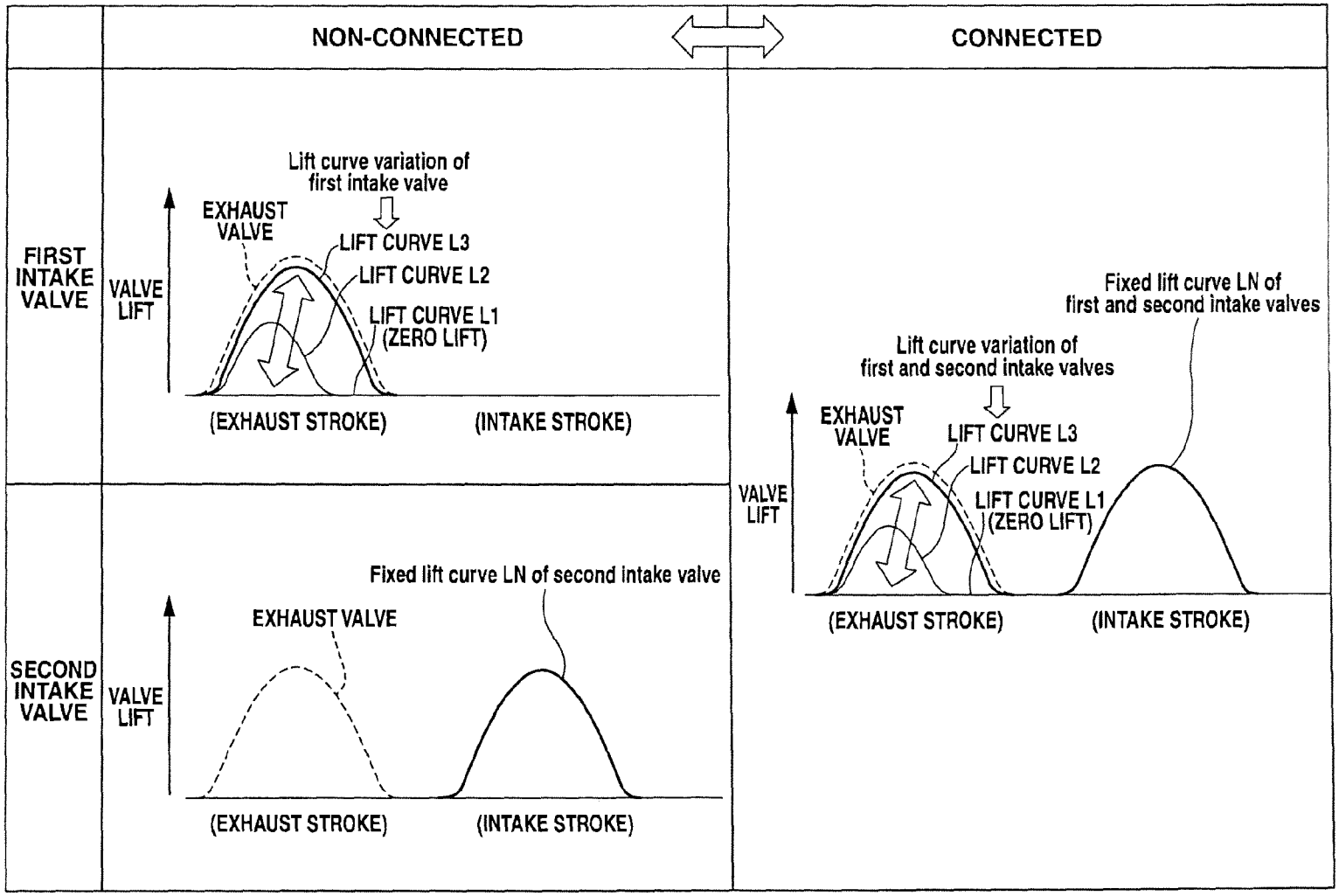
FIG. 21 is valve-lift characteristic views of the first and second intake valves when the connection changeover mechanism has connected both the swing arms with each other and when the connection changeover mechanism has disconnected the swing arms from each other, in the third embodiment.

Next, when the connection changeover mechanism 36 has connected the second swing arm 31 with the first swing arm 30, both of the first and second intake valves 3*a* and 3*b* perform a sub lift during the exhaust stroke and then perform a main lift according to the fixed lift curve LN during the intake stroke, as shown by a right part of FIG. 21.

Since both of the intake valves 3*a* and 3*b* are opened, an intake-air charging efficiency is enlarged resulting in torque increase. Particularly, if torque is required to increase at the utmost extent, the sub lift is set to take the lift curve L1, i.e., is set to produce no lift. In this case, an EGR amount introduced into the cylinder is minimized, so that a charging efficiency of fresh air is enhanced to increase the torque to the utmost extent. If torque is not required to increase so much, the sub lift is set to take some actual lift to introduce some degree of EGR amount. Thereby, the fuel economy can be improved.

A summary of engine-performance effects under the state where the connection changeover mechanism 36 is in the non-connected state in the third embodiment is as follows. That is, during the exhaust stroke, the working angle and lift amount of the first intake valve 3*a* which performs the sub lift are controllably varied, and thereby, the gas amount of EGR which is discharged toward the intake port can be adjusted. At this time, the EGR gas is discharged only from the first intake valve 3*a*, but is not discharged from the second intake valve 3*b*, so that a swirl within the cylinder occurs during the exhaust stroke.

Moreover, since the lift characteristic of the second intake valve 3*b* which performs the main lift during next intake stroke is the fixed one, a stable air-intake operation can be achieved even if the characteristic of the sub lift is controllably varied. Additionally, since this main lift is done only by the second intake valve 3*b*, the swirl occurs also during the intake stroke.

By virtue of the above-mentioned EGR gas-amount adjustment, the exhaust-stroke swirl, the intake-stroke swirl, the stabilization of air-intake operation, and the like; the engine performance such as the fuel economy and an exhaust performance can be improved.

Moreover, by virtue of these, a permissible value of the gas amount of EGR which is introduced into the cylinder can be enlarged. Also from this point of view, the fuel economy and the exhaust performance can be further improved.

On the other hand, as the engine-performance effects under the state where the connection changeover mechanism 36 is in the connected state in the third embodiment, for example, the intake-air charging efficiency can be increased to increase the torque because both the intake valves 3*a* and 3*b* are opened (lifted) as mentioned above.

[Fourth Embodiment]

Figure 22:
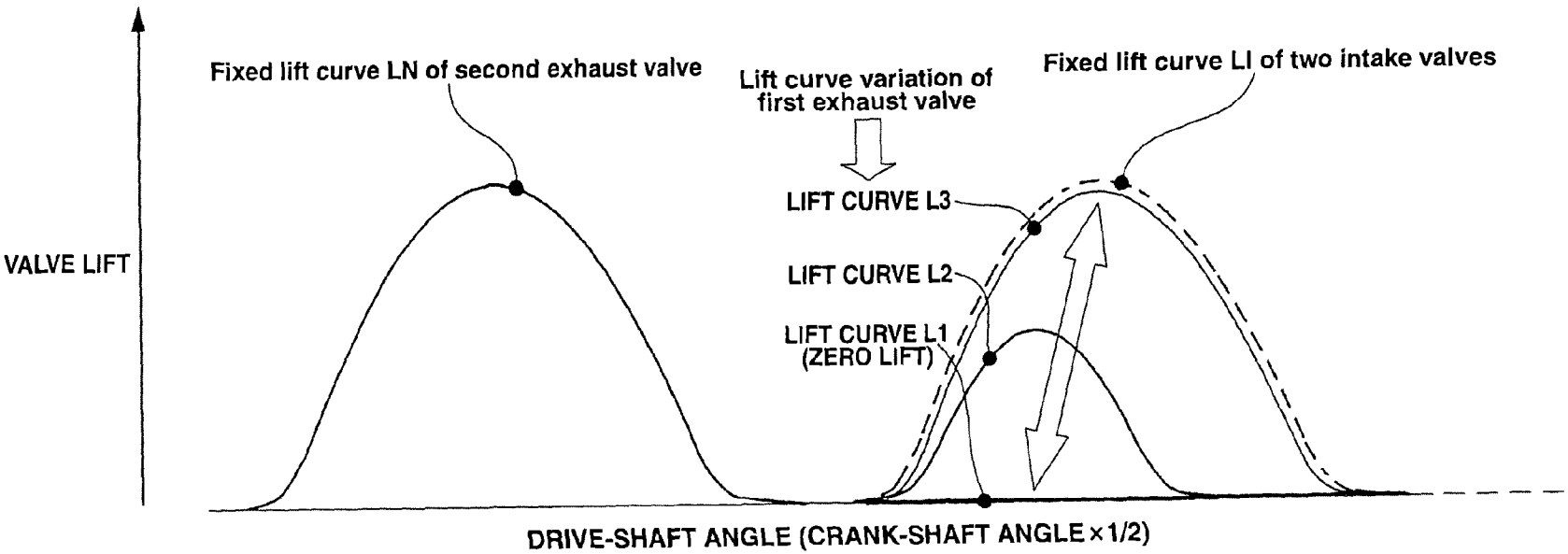
FIG. 22 is a valve-lift characteristic view of first exhaust valve and second exhaust valve in a situation that both the swing arms have been disconnected from each other in a fourth embodiment according to the present invention.
Figure 23:
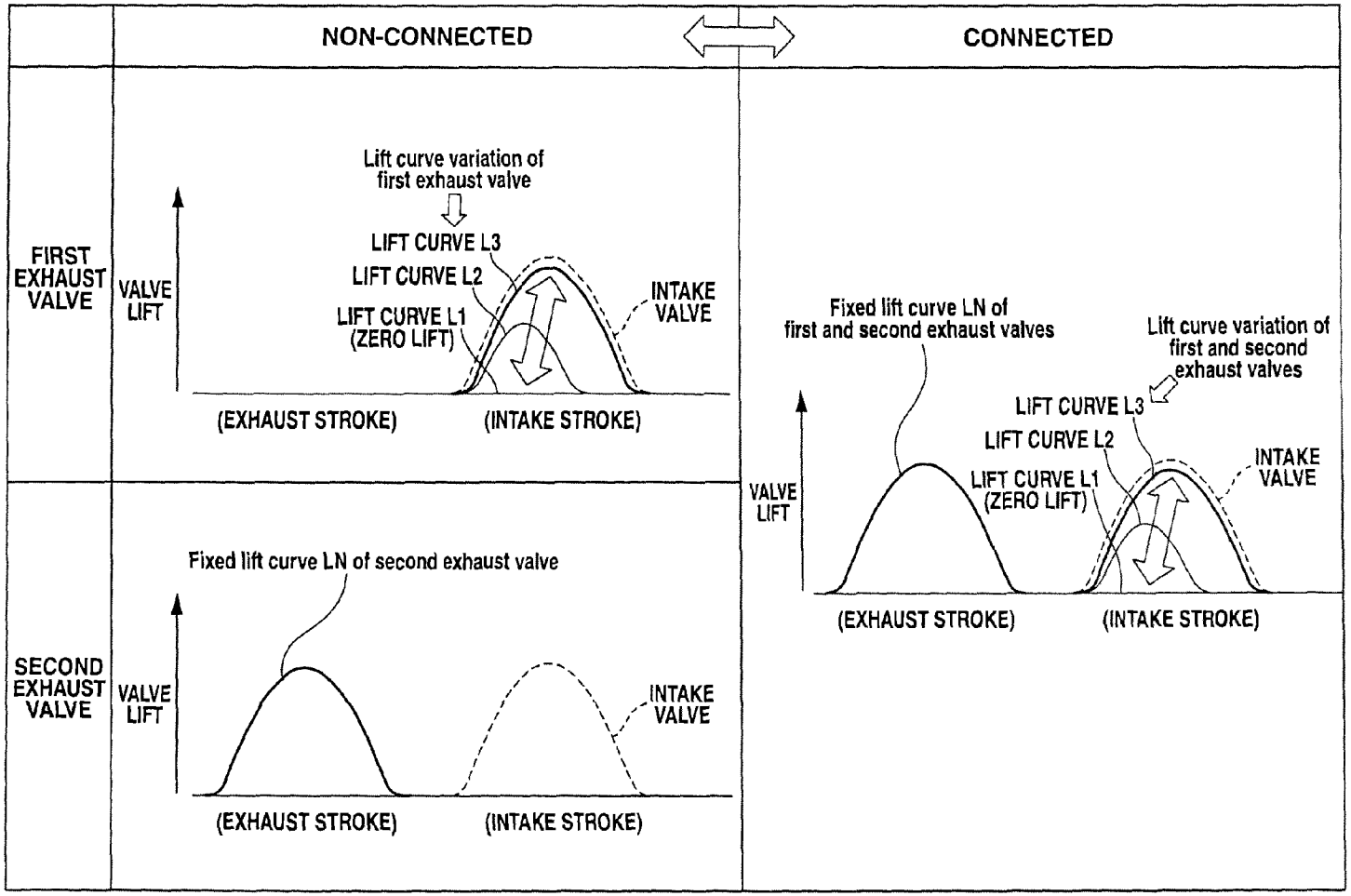
FIG. 23 is valve-lift characteristic views of the first and second exhaust valves when the connection changeover mechanism has connected both the swing arms with each other and when the connection changeover mechanism has disconnected the swing arms from each other, in the fourth embodiment.

FIGS. 22 and 23 show a fourth embodiment according to the present invention. A basic structure of the valve control apparatus in the fourth embodiment is the same as the third embodiment. However, in the fourth embodiment, the valve control apparatus is applied to the exhaust valves in place of the intake valves. That is, as different points from the third embodiment, the first intake valve 3*a* of the third embodiment is replaced with a first exhaust valve 3*a*, and the second intake valve 3*b* of the third embodiment is replaced with a second exhaust valve 3*b*. Moreover, the phase of the second drive cam 50 is advanced by μ in the fourth embodiment although the phase of the second drive cam 50 is retarded by μ in the third embodiment.

As a result, as shown in FIG. 23, after a main lift action of the second exhaust valve 3*b* is performed with the fixed lift curve LN during the exhaust stroke, a sub lift action of the first exhaust valve 3*a* is performed during the intake stroke.

In the fourth embodiment, each of first and second intake valves (not shown) realizes a fixed large lift curve LI (large lift amount) as shown by dotted lines of FIGS. 22 and 23.

A maximum sub lift curve L3 of the first exhaust valve 3*a* may be set to be included in (i.e., to be entirely smaller than) the lift curve LI of the two intake valves. In this case, the exhaust valve opens after the intake valve opens, and then, the exhaust valve closes before the intake valve closes. Hence, the exhaust gas (EGR gas) is inhibited from entering the cylinder under high pressure to heat the inside of cylinder. Therefore, an induction of knocking can be suppressed.

The minimum lift curve L1 of the first exhaust valve 3*a* is set to produce no lift (i.e., is set to have no opening time).

Next, when the connection changeover mechanism 36 has connected the second swing arm 31 with the first swing arm 30, the two exhaust valves 3*a* and 3*b* perform a sub lift during the intake stroke and then perform a main lift according to the fixed lift curve LN during the exhaust stroke subsequent to the combustion, as shown by a right part of FIG. 23. Since both of the exhaust valves 3*a* and 3*b* are opened during the exhaust stroke, an exhaust efficiency is enlarged resulting in torque increase.

Particularly, if torque is required to increase at the utmost extent, the sub lift is set to take the lift curve L1, i.e., is set to produce no lift. In this case, an EGR amount introduced into the cylinder is minimized during the intake stroke, so that the charging efficiency of fresh air is enhanced to increase the torque to the utmost extent. If torque is not required to increase so much, the sub lift is set to take some actual lift to introduce some degree of EGR amount. Thereby, the fuel economy can be improved.

A summary of engine-performance effects under the state where the connection changeover mechanism 36 is in the non-connected state in the fourth embodiment is as follows. That is, during the intake stroke, the working angle and lift amount of the first exhaust valve 3*a* which performs the sub lift action are controllably varied, and thereby, the gas amount of EGR which flows from the exhaust port side into the cylinder can be adjusted. At this time, the EGR gas flows in only from the first exhaust valve 3*a*, but does not flow in from the second exhaust valve 3*b*, so that a swirl within the cylinder occurs during the intake stroke.

Moreover, since the lift characteristic of the second exhaust valve 3*b* which performs the main lift during next exhaust stroke subsequent to combustion is the fixed one, a stable exhaust operation can be achieved even if the characteristic of the sub lift is controllably varied. Additionally, since this main lift is done only by the second exhaust valve 3*b*, the swirl occurs also during the exhaust stroke. A part of this swirl remains during next intake stroke, so that the above-mentioned swirl during the intake stroke can be further enhanced.

By virtue of the above-mentioned EGR gas-amount adjustment, the exhaust-stroke swirl, the intake-stroke swirl, the stabilization of exhaust operation, and the like; the engine performance such as the fuel economy and the exhaust performance can be improved.

Moreover, by virtue of these, a permissible value of the gas amount of EGR which is introduced into the cylinder can be enlarged. Also from this point of view, the fuel economy and the exhaust performance can be further improved.

On the other hand, as the engine-performance effects under the state where the connection changeover mechanism 36 is in the connected state in the fourth embodiment, for example, the exhaust efficiency can be increased to increase the torque because both the exhaust valves 3*a* and 3*b* are opened (lifted) during the exhaust stroke as mentioned above.

[Other Embodiments]

Although the present invention has been described above with reference to the embodiments of the present invention, the present invention is not limited to the embodiments described above. Modifications and variations of the embodiments described above will occur to those skilled in the art in light of the above teachings.

In the above respective embodiments, the pair of swing arms 30 and 31 which are configured to swing about the rocker shaft 32 are provided as the pair of followers. Moreover, the connection changeover mechanism 36 is provided between the pair of swing arms 30 and 31. However, according to the present invention, the pair of swing arms 30 and 31 may be replaced with another-type ones, as the pair of followers. For example, a pair of cylindrical valve lifters of direct-acting type may be provided such that the pair of engine valves are driven respectively via the pair of cylindrical valve lifters of direct-acting-type.

A part of lateral surface of cylindrical shape of each of the valve lifters may be formed with a flat surface portion such that a connection changeover mechanism is provided between the flat surface portions which are in contact with each other.

In the above respective embodiments, the connection changeover mechanism 36 is constructed by the connecting pin 38. However, according to the present invention, the connection changeover mechanism is not limited to this structure. The connection changeover mechanism may be of prop type (lever type) as shown in Japanese Patent Application Publication No. H08-210113. Moreover, the drive source for the connecting pin is not limited to the hydraulic pressure (oil pressure). That is, according to the present invention, the connecting pin may be driven by an electromagnetic solenoid as shown in Japanese Patent Application Publication No. 2012-002095.

Moreover, in the above respective embodiments, the variable mechanism which continuously varies the lift amount of the first engine valve and thereby operates the first engine valve is driven by the eccentric cam provided as the drive cam. However, according to the present invention, the drive cam is not limited to the eccentric cam, but may be an egg-shaped cam as shown in Japanese Patent Application Publication No. 2007-321653 (corresponding to US Patent Application Publication No. 2007/0277755).

Moreover, a variable mechanism which can vary the phase may be provided together with a chain sprocket (not shown) provided at a tip portion of the drive shaft, as shown in Japanese Patent Application Publication No. 2009-074414 (corresponding to US Patent Application Publication No. 2009/0078223). In such a case, a correlation between intake valve timing and exhaust valve timing can be varied, so that a further improvement of performance is promising.

[Configurations and Effects]

Some technical configurations obtainable from the above embodiments according to the present invention will now be listed with their advantageous effects.

[a] A valve control apparatus for an internal combustion engine, comprising: a first engine valve (3*a*) biased in a closing direction of the first valve (3*a*) by a biasing force of a valve spring (10*a*); a second engine valve (3*b*) biased in a closing direction of the second valve (3*b*) by a biasing force of a valve spring (10*b*); a first drive cam (5) provided on a drive shaft (4) and configured to rotate integrally with the drive shaft (4), the drive shaft (4) being configured to rotate in synchronization with a crankshaft; a second drive cam (13, 50) provided on the drive shaft (4) and configured to rotate integrally with the drive shaft (4); a swing cam (7) configured to swing; a transmission mechanism (8) configured to convert a rotational motion of the first drive cam (5) into a swinging force and to transmit the swinging force to the swing cam (7); a first swing arm (30) configured to open the first engine valve (3*a*) by being pressed by a swing of the swing cam (7); a second swing arm (31) configured to open the second engine valve (3*b*) by being pressed by a rotation of the second drive cam (13, 50); a control mechanism (9) configured to vary a swing amount of the swing cam (7) by varying an attitude of the transmission mechanism (8); and a connection changeover mechanism (36) configured to connect and disconnect the first swing arm (30) with/from the second swing arm (31). Accordingly, when the connection changeover mechanism (36) has disconnected the first swing arm (30) from the second swing arm (31), a lift amount characteristic of one of the engine valves (3*a*, 3*b*) does not vary in conjunction with a lift amount characteristic of another of the engine valves (3*a*, 3*b*) because both the swing arms (30, 31) are not influenced from each other.

[b] The valve control apparatus as described in the above item [a], wherein the first and second engine valves (3*a*, 3*b*) are first and second intake valves, and a lift characteristic of the second intake valve is set to have a predetermined lift amount (LN) and a predetermined working angle (DN) which are smaller than a minimum lift amount and a minimum working angle obtainable within a control range of the first intake valve, in a case that the connection changeover mechanism (36) has disconnected the first swing arm (30) from the second swing arm (31).

[c] The valve control apparatus as described in the above item [b], wherein an outer diameter of the second drive cam (13) is smaller than an outer diameter of the drive shaft (4).

[d] The valve control apparatus as described in the above item [b], wherein the first swing arm (30) includes a roller (34) rotatably abutting on the swing cam (7).

Since the swing cam (7) changes its frictional direction at the contact portion between the first swing arm (30) and the swing cam (7), the swing cam (7) is easy to wear. However, by using such a roller (34), the generation of wear (abrasion) can be suppressed.

[e] The valve control apparatus as described in the above item [b], wherein the second swing arm (31) includes a contact surface (35*a*) configured to become in contact with the second drive cam (13).

Since a frictional direction of the rotating second drive cam (13) is fixed (not changed), the contact portion between the second drive cam (13) and the second swing arm (31) is difficult to wear. Hence, the contact portion between the second drive cam (13) and the second swing arm (31) can be constituted by a mere contact surface (35*a*) without a roller. Accordingly, the cost reduction can be attained as compared with the case that a roller is provided.

[f] The valve control apparatus as described in the above item [a], wherein the connection changeover mechanism (36) includes a connection hole (37*b*) formed in the first swing arm (30), a connection hole (37*a*) formed in the second swing arm (31), a connecting member (38) provided to be able to move inside the connection holes (37*a*, 37*b*) of the first and second swing arms (30, 31), a biasing member (39) provided in at least one of the connection holes (37*a*, 37*b*) of the first and second swing arms (30, 31), and configured to bias the connecting member (38) in one direction, and a hydraulic-pressure supply passage (43) through which a hydraulic pressure for moving the connecting member (38) against a biasing force of the biasing member (39) is supplied to at least one of the connection holes (37*a*, 37*b*) of the first and second swing arms (30, 31).

[g] The valve control apparatus as described in the above item [a], wherein a characteristic of the second engine valve is set to have a predetermined lift amount (LN) which is larger than a maximum lift amount obtainable within a control range of the first engine valve and to have a predetermined working angle (DN) which is larger than a maximum working angle obtainable within the control range of the first engine valve, in a case that the connection changeover mechanism (36) is in a non-connected state.

[h] The valve control apparatus as described in the above item [g], wherein the first swing arm (30) is equipped with a roller (34) configured to freely rotate at a contact portion between the swing cam (7) and the first swing arm (30), and the second swing arm (31) is equipped with a roller (51) configured to freely rotate at a contact portion between the second drive cam (50) and the second swing arm (31)

Accordingly, a stable swing can be attained by the rotatable contact by use of the roller (34) in the case that the fixed lift is large.

[i] The valve control apparatus as described in the above item [h], wherein the swing cam (7) is constituted by dividable two members that sandwich the drive shaft (4) therebetween.

Accordingly, the swing cam (7) can be attached, for example, even if the second drive cam is formed integrally with the drive shaft (4). Hence, an assembling workability is improved.

[j] The valve control apparatus as described in the above item [a], wherein the first and second engine valves (3*a*, 3*b*) are first and second intake valves, and opening and closing of the first intake valve are performed during an exhaust stroke, and opening and closing of the second intake valve are performed during an intake stroke, in a case that the connection changeover mechanism (36) is in a non-connected state.

Accordingly, a suction of EGR gas can be conducted because one of the intake valves is opened during the exhaust stroke. Therefore, the fuel economy is improved. Moreover, a swirl of the EGR gas can be produced because only one of the intake valves is lifted.

[k] The valve control apparatus as described in the above item [j], wherein an open period of the first intake valve does not overlap with an open period of the second intake valve in the case that the connection changeover mechanism (36) is in the non-connected state.

Accordingly, a stable operation can be realized because a drive cam which is actually opening the two valves when the connection changeover mechanism (36) is in the connected state is not switched between the two drive cams during the open state of the valves.

[l] The valve control apparatus as described in the above item [k], wherein working angle and lift amount of the first intake valve are smaller than working angle and lift amount of an exhaust valve even when each of the working angle and lift amount of the first intake valve takes a maximum level obtainable within a control range thereof.

Accordingly, excessive amount of exhaust gas can be inhibited from being introduced into the intake port on the side of the intake valve because the intake valve opens and closes within a range of the lift amount of the exhaust valve. As a result, a problem that the exhaust gas hits against an air cleaner and the like to generate an abnormal noise can be suppressed.

[m] The valve control apparatus as described in the above item [k], wherein a swing amount of the first swing arm (30) which is derived from the swing cam (7) is substantially equal to 0 in a case that the connection changeover mechanism (36) is in a connected state.

That is, the first swing arm does not open the valve during the exhaust stroke when the connection changeover mechanism is in the connected state. Thereby, a rate of fresh air is increased so that torque can be increased in the high speed region or the like of the engine in which high torque is needed.

[n] The valve control apparatus as described in the above item [a], wherein the first and second engine valves (3*a*, 3*b*) are first and second exhaust valves, and opening and closing of the first exhaust valve are performed during an intake stroke, and opening and closing of the second exhaust valve are performed during an exhaust stroke, in a case that the connection changeover mechanism (36) is in a non-connected state.

Accordingly, a suction of EGR gas can be conducted because one of the exhaust valves is opened (lifted) during the intake stroke. Therefore, the fuel economy is improved. Moreover, a swirl of the EGR gas can be produced because only one of the exhaust valves is lifted.

[o] The valve control apparatus as described in the above item [n], wherein an open period of the first exhaust valve does not overlap with an open period of the second exhaust valve in the case that the connection changeover mechanism (36) is in the non-connected state.

Accordingly, a stable operation can be realized because a drive cam which is actually opening the two valves when the connection changeover mechanism (36) is in the connected state is not switched between the two drive cams during the open state of the valves.

[p] The valve control apparatus as described in the above item [o], wherein the open period and lift amount of the first exhaust valve are smaller than open period and lift amount of an intake valve even when each of the open period and lift amount of the first exhaust valve takes a maximum level obtainable within a control range thereof.

[q] The valve control apparatus as described in the above item [a], wherein the connection changeover mechanism (36) is configured to connect and disconnect the first swing arm (30) with/from the second swing arm (31) when base circular portions of the swing cam (7) and the second drive cam (13, 50) are causing the first engine valve (3*a*) and the second engine valve (3*b*) to be in a closed state.

That is, motions of both the swing arms (30, 31) are in a stopped state when both of the first engine valve (3*a*) and the second engine valve (3*b*) are in the closed state. At this time, the connection changeover mechanism (36) can stably connects and disconnects the first swing arm (30) with/from the second swing arm (31).

[r] The valve control apparatus as described in the above item [a], wherein a lift amount of the first engine valve (3*a*) is controlled to become small at the time of low rotational speed of the engine and to become large at the time of high rotational speed of the engine.

[s] The valve control apparatus as described in the above item [a], wherein the connection changeover mechanism (36) is configured to connect and disconnect the first swing arm (30) with/from the second swing arm (31) in accordance with a rotational speed of the engine.

Accordingly, the output power can be adjusted by switching between the connected state and the unconnected state of the connection changeover mechanism (36) in accordance with the rotational speed of the engine.

This application is based on prior Japanese Patent Application No. 2012-201121 filed on Sep. 13, 2012. The entire contents of this Japanese Patent Application are hereby incorporated by reference.

The scope of the present invention is defined with reference to the following claims.

What is claimed is:

1. A valve control apparatus for an internal combustion engine, comprising:

a first engine valve biased in a closing direction of the first engine valve by a biasing force of a first valve spring;

a second engine valve biased in a closing direction of the second engine valve by a biasing force of a second valve spring;

a first drive cam provided on a drive shaft and configured to rotate integrally with the drive shaft, the drive shaft being configured to rotate in synchronization with a crankshaft;

a second drive cam provided on the drive shaft and configured to rotate integrally with the drive shaft;

a swing cam configured to swing;

a transmission mechanism configured to convert a rotational motion of the first drive cam into a swinging force and to transmit the swinging force to the swing cam;

a first swing arm configured to open the first engine valve by being pressed by a swing of the swing cam;

a second swing arm configured to open the second engine valve by being pressed by a rotation of the second drive cam;

a control mechanism configured to vary a swing amount of the swing cam by varying an attitude of the transmission mechanism; and a connection changeover mechanism configured to connect and disconnect the first swing arm with and from the second swing arm, wherein a lift characteristic of the second engine valve as determined by the configuration of the second swing arm for opening the second engine valve by being pressed by the second drive cam is one fixed lift curve, and wherein the one fixed lift curve has a lift amount and a working angle which are smaller than a minimum lift amount and a minimum working angle within a lift characteristic of the first engine valve as determined by the configuration of the first swing arm for opening the first engine valve by being pressed by the swing cam.

2. The valve control apparatus as claimed in claim 1, wherein the first and second engine valves are first and second intake valves, and a lift characteristic of the second intake valve as determined by the configuration of the second swing arm for opening the second intake valve by being pressed by the second drive cam has a predetermined lift amount and a predetermined working angle which are smaller than a minimum lift amount and a minimum working angle within an operating control range of the first intake valve, in a case that the connection changeover mechanism has disconnected the first swing arm from the second swing arm.

3. The valve control apparatus as claimed in claim 2, wherein an outer diameter of the second drive cam is smaller than an outer diameter of the drive shaft.

4. The valve control apparatus as claimed in claim 2, wherein the first swing arm includes a roller rotatably abutting on the swing cam.

5. The valve control apparatus as claimed in claim 2, wherein the second swing arm includes a contact surface configured to become in contact with the second drive cam.

6. The valve control apparatus as claimed in claim 1, wherein the connection changeover mechanism includes a connection hole formed in the first swing arm, a connection hole formed in the second swing arm, a connecting member provided to be able to move inside the connection holes of the first and second swing arms, a biasing member provided in at least one of the connection holes of the first and second swing arms, and configured to bias the connecting member in one direction, and a hydraulic-pressure supply passage through which a hydraulic pressure for moving the connecting member against a biasing force of the biasing member is supplied to at least one of the connection holes of the first and second swing arms.

7. The valve control apparatus as claimed in claim 1, wherein the connection changeover mechanism is configured to connect and disconnect the first swing arm with and from the second swing arm when base circular portions of the swing cam and the second drive cam are causing the first engine valve and the second engine valve to be in a closed state.

8. The valve control apparatus as claimed in claim 1, wherein the connection changeover mechanism is configured to connect and disconnect the first swing arm with and from the second swing arm in accordance with a rotational speed of the engine.

9. A valve control apparatus for an internal combustion engine, comprising:

a first drive cam configured to be rotated drivingly by a rotational force of a crankshaft;

a second drive cam configured to be rotated drivingly by the rotational force of the crankshaft;

a first engine valve biased in a closing direction of the first engine valve by a first valve spring;

a second engine valve biased in a closing direction of the second engine valve by a second valve spring;

a transmission mechanism configured to convert a rotational motion of the first drive cam into a swinging motion and to transmit the swinging motion to a swing cam;

a control mechanism configured to vary a swing amount of the swing cam by varying an attitude of the transmission mechanism;

a first follower configured to open and close the first engine valve by a contact with the swing cam;

a second follower configured to open and close the second engine valve by a contact with the second drive cam; and a changeover mechanism configured to form an interlock between opening amount and open-close timing of the first follower and opening amount and open-close timing of the second follower, and configured to release the interlock, wherein a lift characteristic of the second engine valve as determined by the configuration of the second follower for opening and closing the second engine valve by the contact with the second drive cam is one fixed lift curve, and wherein the one fixed lift curve has a lift amount and a working angle which are smaller than a minimum lift amount and a minimum working angle within a lift characteristic of the first engine valve as determined by the configuration of the first follower for opening and closing the first engine valve by the contact with the swing cam.

10. A valve control apparatus for an internal combustion engine, comprising:

a pair of engine valves including a first engine valve and a second engine valve;

a first follower configured to drivingly open and close the first engine valve;

a second follower configured to open and close the second engine valve;

a first drive cam configured to rotate in synchronization with a crankshaft;

a swing cam configured to drivingly press the first follower;

a transmission mechanism configured to convert and transmit a rotational motion of the first drive cam to a swinging motion of the swing cam;

a control mechanism configured to vary a transfer characteristic of the transmission mechanism by varying an attitude of the transmission mechanism;

a second drive cam configured to rotate in synchronization with the crankshaft and to drive the second follower; and a changeover mechanism configured to switch between an interlocked state of the first follower and the second follower and a non-interlocked state of the first follower and the second follower, wherein a lift characteristic of the second engine valve as determined by the configuration of the second follower for opening and closing the second engine valve by being driven by the second drive cam is one fixed lift curve, and wherein the one fixed lift curve has a lift amount and a working angle which are smaller than a minimum lift amount and a minimum working angle within a lift characteristic of the first engine valve as determined by the configuration of the first follower for opening and closing the first engine valve by being pressed by the swing cam.

* * * * *